US005117750A

United States Patent [19]

Mosier, II et al.

[11] Patent Number: 5,117,750

[45] Date of Patent: Jun. 2, 1992

[54] COMPACTOR

[75] Inventors: Kenneth C. Mosier, II, Clayton; Burdette D. Thomson, Germantown, both of Ohio

[73] Assignee: Automated Fluid Systems Inc., Dayton, Ohio

[21] Appl. No.: 734,500

[22] Filed: Jul. 23, 1991

Related U.S. Application Data

[63] Continuation-in-part of Ser. No. 558,657, Jul. 26, 1990, abandoned.

[51] Int. Cl.[5] ..... B30B 3/00; B30B 5/00

[52] U.S. Cl. ..... 100/45; 53/526; 53/527; 100/99; 100/155 R; 100/177; 100/229 A; 141/77

[58] Field of Search ..... 100/45, 99, 122, 123, 100/144, 151, 155 R, 168, 169, 177, 244, 229 A; 53/526, 527; 141/71, 73, 75, 77, 80, 114

[56] References Cited

U.S. PATENT DOCUMENTS

| | | | |
|---|---|---|---|
| 720,053 | 2/1903 | McKibben | 141/77 X |
| 824,592 | 6/1906 | Schayer | 100/123 X |
| 831,041 | 9/1906 | Davis et al. | 100/123 X |
| 1,474,625 | 11/1923 | Eckert | 100/123 X |
| 1,649,362 | 11/1927 | Nagel | 100/155 R X |
| 1,730,295 | 10/1929 | Reuther | 141/77 X |
| 1,777,224 | 9/1930 | Reuther | 141/77 X |
| 2,781,799 | 2/1957 | Bradford | 141/77 X |
| 2,871,891 | 2/1959 | Lau | 141/77 X |
| 2,915,866 | 12/1959 | Bartlo | 53/526 |
| 2,956,383 | 10/1960 | Gausman | 53/526 |
| 4,324,088 | 4/1982 | Yamashita et al. | 53/527 |
| 4,719,851 | 1/1988 | Chesnut | 100/45 |
| 4,735,136 | 4/1988 | Lee et al. | 100/99 X |

FOREIGN PATENT DOCUMENTS

| | | | |
|---|---|---|---|
| 181990 | 3/1907 | Fed. Rep. of Germany | 100/123 |
| 802326 | 2/1951 | Fed. Rep. of Germany | 141/77 |

*Primary Examiner*—Harvey C. Hornsby
*Assistant Examiner*—Stephen F. Gerrity
*Attorney, Agent, or Firm*—Biebel & French

[57] ABSTRACT

A compacting apparatus is provided for compressing material within a flexible bag including a pair of compression rollers which move from an upper to a lower position within the apparatus while contacting the bag. Vertically extending guide rails are provided for guiding the rollers in their movement and the rails are oriented in diverging relationship to each other to allow the rollers to move outwardly as they move downwardly. In addition, the guide rails are mounted to permit at least one of the rollers to pivot outwardly as the bag is filled with material and as the material is compacted.

22 Claims, 25 Drawing Sheets

129

16
128
34'
35'
42
21
10
127
70
20
101'
18
90'
102'
108
14
101
102
35
106
90
40
101
90
40
32'
36
126
99
M
102
105
125
97
126
25
56
3
12
24
120
22
36
126
125
125
34
32
3

12
14
20
24
25
40
43
50
60
70
71
74
90
104
105
112
115
116
125
126
129
B
P 20
115
B
60
8
74
71
70
112
90
129
P
14
125
25
126
40
116
50
24
105
104
12
62
43

372
329
374
310'
260'
221
216
234'
242
374
210
270
290'
327
374
220
312'
270
292
218
235
374
312'
240
309'
304
370
352
214
290'
240
354
232'
308'
356
370
305
236'
242
290
M
352
308
20
291
250'
378
358
212
378
222
234
236
232
376
20

COMPACTOR

CROSS-REFERENCE TO RELATED APPLICATION

This application is a continuation-in-part of copending application Ser. No. 07/558,657, filed Jul. 26, 1990(now abandoned).

BACKGROUND OF THE INVENTION

This invention relates to new and improved compactors which, as compared to prior art devices applied to similar purposes, are, for any given volumetric capacity thereof, economical to fabricate, more efficient and satisfactory in use, readily adaptable to a wider variety of applications, easier and less costly to service and maintain, more resistant to serious malfunction and inherently endowed with the ability to more effectively reduce and consolidate the substance and materials on which they operate.

Embodiments of the present invention are also distinguished by safety and cleanliness in operation and are highly advantageous for use in solving many of the serious problems found to inherently exist in the handling and disposal of waste, refuse and debris in fast food establishments, cafeterias and other types of restaurants, groceries and the average office, commercial and industrial buildings and shopping malls wherein much food, drink and resultant refuse and debris in the form of garbage, waste paper, dirty rags, small plastic utensils and similar compressible, disposable materials are found to exist in abundance. The net result of such conditions has been the creation of ever increasing environmental and health problems in the facilities mentioned. These problems have been difficult to cope with in such places due to the fact that heretofore the means available to deal with them have been either inadequate, inefficient, unsafe, too costly or too space consuming to permit or justify their use.

A most important development of the present invention is that it enables the creation of highly effectively sophisticated embodiments thereof which can be incorporated in small compact refuse receptacles for use with disposable waste storage bags and so function that for any given application thereof, they enable one to significantly multiply the amount of waste, refuse and debris that can be contained and stored within a single waste disposal bag of any given volumetric capacity. This is a feature which derivately produces significant economy and facility in the subsequent handling and disposition of the bagged waste, refuse and debris. The invention will therefore be illustratively shown and described in this context, but only by way of example and not by way of imitation either as to form of its embodiment or the nature of its application.

SUMMARY OF THE INVENTION

The present invention provides a compacting apparatus for compressing material within a flexible bag having an open mouth portion for receiving the material. The apparatus includes a support frame defining upper and lower portions of the apparatus and a bag support structure attached to the support frame for supporting a bag with the open mouth portion thereof adjacent to the upper portion of the apparatus.

Compressing means in the form of a pair of rollers are located on either side of the bag whereby opposing sides of the bag are forced inwardly. The rollers are movable between an upper position adjacent to the upper portion of the apparatus and a lower position adjacent to the lower portion of the apparatus. As the rollers move along the length of the bag, they press inwardly and downwardly on waste material within the bag to cause compaction of the waste.

Further, the rollers move in a cyclic loop-like path including a compression phase of movement wherein the rollers pass in contact with the bag through a central portion of the apparatus containing the bag and subsequently move outwardly away from the central portion out of contact with the bag. The rollers are then moved upwardly toward the upper portion of the apparatus in a return phase of movement, and finally undergo an inward movement toward the central portion of the apparatus in preparation for another compression phase. During each compression phase, the waste material within the bag is compressed or compacted further such that entrapped air within the waste is removed and a closely compacted mass is formed.

The rollers are guided in their downward movement by guide means in the form of rails which bias the rollers inwardly toward the central portion of the apparatus and into contact with the bag. The guide means on opposing sides of the bag are oriented in diverging relationship to each other such that as the rollers reach the lower more compacted portion of the bag they will be guided outwardly.

In addition, the guide rails on at least one side of the bag are supported for pivotal movement such that as compaction of the waste increases the guide rails will permit the rollers to move outwardly an increasing amount depending on the compaction and amount of waste within the bag. Resilient biasing means such as springs are provided for biasing the pivoted guide rails toward the bag to insure that a minimum amount of compaction occurs during the roller's movement relative to the bag.

Accordingly, it is an object of the present invention to provide a compactor capable of accommodating the introduction and handling of a great volume of waste and effectively reducing such waste to a small compact mass such that the amount of waste accommodated within a waste disposal bag of given volumetric capacity is multiplied.

It is a further object of the invention to provide a compactor which avoids malfunctions and reduces the labor and cost incurred in use and maintenance thereof.

It is another object of the present invention to provide a compactor which requires a minimum of space and which reduces the time, labor, expense and dangers normally entailed in the handling and disposal of waste material.

It is a further object of the invention to provide a compactor which contributes to the reduction of potential health and environmental problems in the areas in which it is used.

Other objects and advantages of the invention will be apparent from the following description, the accompanying drawings and the appended claims.

DETAILED DESCRIPTION OF THE PREFERRED EMBODIMENT

Figure 1:
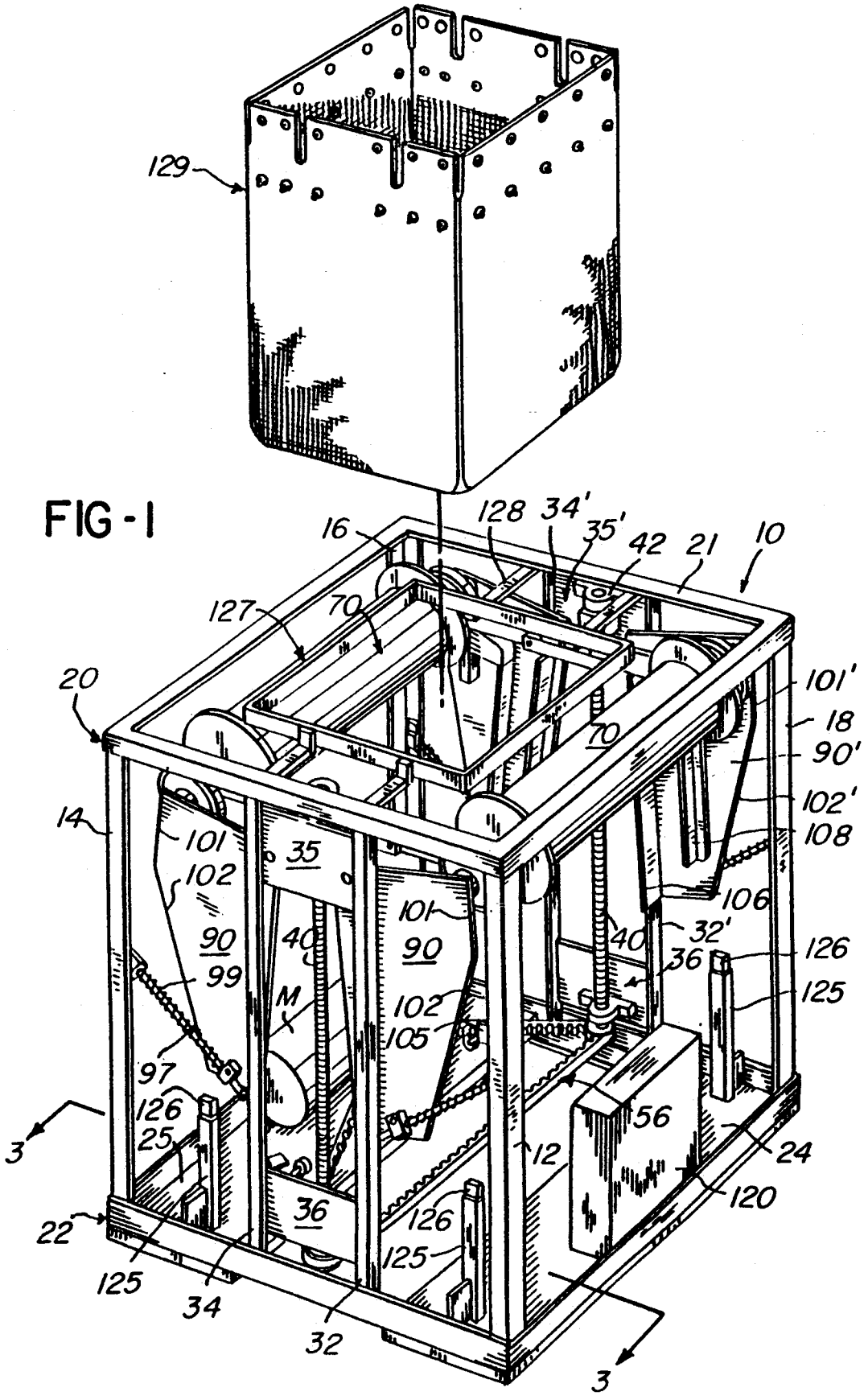
FIG. 1 is an exploded perspective view of one illustrative embodiment of the present invention.
Figure 2:
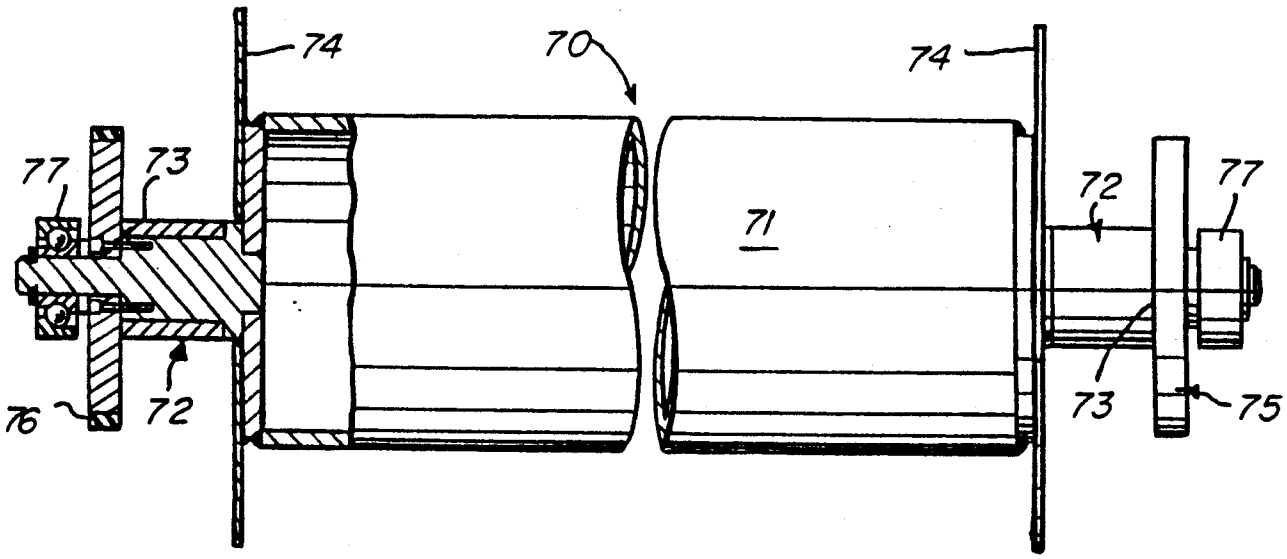
FIG. 2 is a view exhibiting details of the compression roller assemblies employed therein.

Like parts are designated by like reference characters throughout the several views in certain of which, as will be apparent, parts have been removed for clarity of disclosure.

The embodiment of the invention shown in FIGS. 1–18 includes a skeletal, rectangular, box-like framework 10. In this instance framework 10 is basically formed of lengths of angle iron, all of the same configuration, having a 90° included angle and a substantially identical cross-sectional dimension. Framework 10 is a rigid, rugged, vertically extending free standing structure comprised of four vertically oriented corner posts, namely a left front corner post 12, a left rear corner post 14, a right rear corner post 16 and a right front corner post 18 which are rectangularly arranged. These posts have their upper extremities nested within and welded to the corners of a capping rectangular frame 20 of angle iron the exterior top surface 21 of which forms a narrow rectangular frame bounding an opening to the interior of the framework 10. The lower extremities of posts 12, 14, 16 and 18 are similarly nested within and welded to the corners of a rectangular frame 22 which is inverted but otherwise identical in size and configuration to frame 20 and thus vertically aligned therewith.

Each of the exterior faces of framework 10 presents to the eye of the observer a facade having the configuration of a narrow rectangular frame which is planar and bounds a rectangular opening. The front and rear faces of framework 10 are parallel, as are its side faces. The lateral extent of the sides and correspondingly the front to rear dimension of the interior of framework 10 is greater than the side to side dimension thereof.

Secured, by welding, to the bottom exterior surface of frame 22, in transversely bridging relation to its outer side surfaces and positioned in a spaced parallel relation from front to rear thereof, are two oblong plates 24, 25 which establish that portion of the base of framework 10 therebetween in a modestly elevated spaced relation to its underlying ground surface. This contributes to the portability and lends ease in effecting its movement from one place to another within a given environment.

As viewed from the front thereof, within framework 10, welded to the left side of its interior surface in equidistantly spaced parallel relation to corner posts 12 and 14, is a further pair of posts 32 and 34 formed of angle iron which are vertically oriented, extend from top to bottom thereof and are themselves in a spaced parallel relation. As seen in FIG. 1 of the drawings, posts 32 and 34 are in a directly aligned, facing relation to a like pair of posts 32′ and 34′ similarly installed in the interior of framework 10 in connection with the interior surface portion thereof defining its right side. Accordingly, posts 32′ and 34′ are centered between and parallel to posts 16 and 18.

Figure 3:
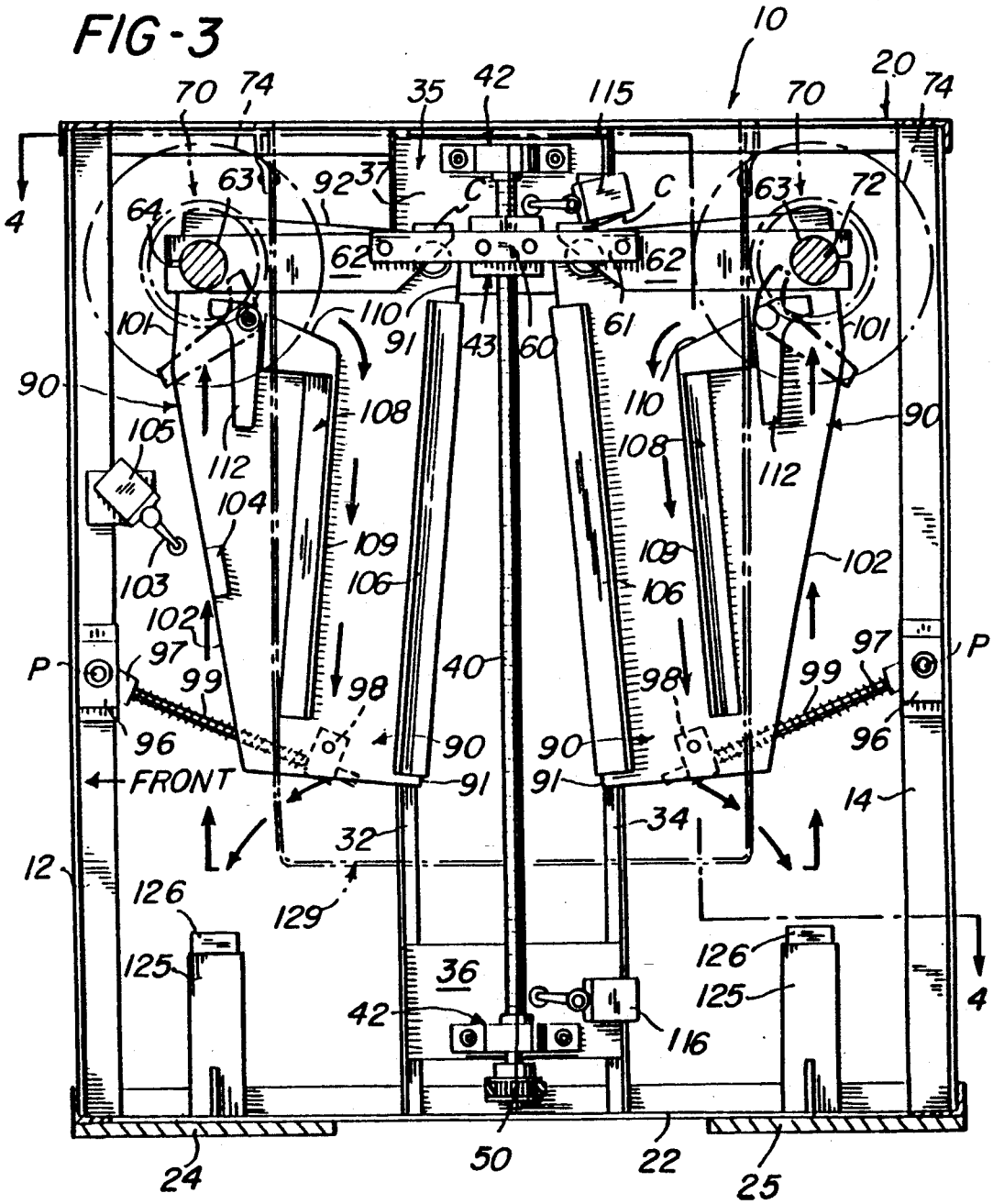
FIG. 3 is a view taken on line 3—3 of FIG. 1 which reveals the compression roller assemblies, their tracking plates and interrelated controls in a state of readiness to commence their cyclic operation as and when energized.

Nested within and fixed in bridging relation to upper end portions of posts 32 and 34, as seen in FIGS. 1 and 3, is a rectangular plate 35 the inwardly facing surface 37 of which is in an aligned, directly facing relation to surface 37′ of an identical plate 35′ similarly nested between and in bridging, fixed relation to upper end portions of posts 32′ and 34′. The upper horizontal edge of each of plates 35 and 35′ is in closely spaced relation below a horizontal portion of frame 20.

The respective pairs of posts 32, 34 and 32′, 34′ also have an identical plate, respectively 36, 36′, nested between the posts thereof and fixed in bridging relation thereto at points adjacent and identically spaced from their lower ends. Thus, plates 36, 36′ are also in a directly aligned facing relation. Note that the vertical extent of each of plates 36, 36′ is less than that of plates 35, 35′ and their lower horizontal edges are in a horizontal plane spaced above the bottom frame 22 of framework 10.

Mounted within the limits of the interior of framework 10 immediately of each side thereof and laterally centered between posts 32, 34 and 32'. 34' thereof is a vertically oriented screw 40, 40', respectively, having reduced diameter thread-free end portions each of which is projected through and in bearing relation to a pillow block 42, one of which is mounted in fixed relation to each of the plates 35, 36, 35' and 36'. Suitable means are applied to preclude axial movement of screws 40, 40' with respect to their pillow blocks 42 so that when these screws are energized they are constrained to rotate in place. Attention is directed to the fact that the uppermost pillow blocks are just short of the upper limit of the interior of framework 10, the lowermost pillow blocks are spaced above its lower limit and screws 40, 40' depend to a point just short of the bottom of the interior of the framework. Below its lowermost pillow block each of screws 40, 40' securely mounts a releasably interconnected pinion. These pinions, respectively designated 50 and 50' (see FIG. 3) are co-planar.

Referring to FIG. 3, each of screws 40, 40' mounts thereon, between the locations of the pillow blocks by which it is supported, a threadably engaged, rectangularly configured, block-shaped nut 43, 43', respectively having a horizontally extended tie bar 60, 60' fixed in abutment with that surface thereof which is innermost of the interior of framework 10. The end portions of the respective tie bars project equidistantly beyond the lateral extremities of the nut to which it is fixed.

Nuts 43 and 43' are in the first instance positioned and constrained to insure that during such times as the screws to which they apply are energized they will move vertically, upwardly and downwardly thereof, in a constantly facing aligned relation and correspondingly maintain a common horizontal level. As will be further described, the vertical extent of travel of nut 43 is determined by normally closed limit switches 115 and 116 and the extent of travel of nut 43' derivatively limited thereby.

Framework 10 further mounts, within its interior, a pair of modified rectangular plates 90 located in a vertical plane at the left side thereof between and parallel to the vertical planes of surface 37 of plate 35 and the facing surface of nut 43. The lengths of plates 90 are generally vertically disposed and screw 40 is located in an equidistantly laterally spaced relation to their respectively adjacent side edges 90 which are linear in form and originally set in a modest downwardly divergent relation. As originally set (FIG. 3) the adjacent side edges 91 are identically inclined from a vertical to an extent which is preferably held in a range from about 3° to about 5°. Upper edge 92 of each plate 90 is also linear in character and defines a 90° angle between it and the plate edge 91.

As viewed from the interior of framework 10 (FIG. 3), the upper right corner portion of the plate 90 to the left of screw 40 is in an overlapping, pivotaly connected relation to the lower left corner of plate 35. The upper left corner portion of the plate 90 to the right of screw 40 is similarly disposed in an overlapping, pivotally connected relation to the lower right corner of plate 35. Consequently the adjacent upper corners of plates 90 are derivatively connected to the framework 10.

The interior surface of the front corner post 12 at the left side of framework 10, from which the left side edge of the left plate 90 is normally spaced, mounts a bracket 96 secured thereto at a location and level adjacent but spaced from and above that of the lowermost edge portion of the left plate 90. A pivot pin P passing through a central elevated portion of this bracket is secured to extend therefrom perpendicular to its backing surface (provided by post 12). Between this elevated central portion of bracket 96 and its backing surface, pin P passes freely through an aperture in the enlarged head end portion of a longitudinally extended rod 97, by means of which rod 97 is pivotally interconnected with post 12 of framework 10. The opposite end portion of rod 97 projects through an aperture in bearing, or sliding, relation to a block 98 which is pivotally connected to the left plate 90 to project outwardly from that face thereof immediately of the left side of framework 10. As so connected, block 98 is in a spaced, adjacent and substantially centered relation to the lateral limits of the lower edge of the left plate 90.

In this instance the original setting of plates 90 is as seen in FIG. 3 of the drawings and it is prescribed that the adjacent upper corners of plates 90 be not appreciably less than about five inches apart.

Intermediate the limits of the enlarged head portion of rod 97 and block 98, rod 97 mounts thereabout a coil spring 99 the ends of which respectively abut and bias against the shoulder defined by the head of rod 97 and that surface of block 98 which is in a directly facing relation to this shoulder. The bias so provided is such to accommodate a limited clockwise displacement of left plate 90 in a manner and for purposes to be further described.

It should be noted that by virtue of the above described suspension and conditioning thereof in the first instance left plate 90, as shown in FIG. 3, has a stable triangularly supported pivotal mount to framework 10 which originally sets its left edge 101, 102 in a relatively adjacent spaced relation to the front corner post 12. The upper portion 101 of the left side edge of left plate 90 is short in length, perpendicular to upper edge 92 and parallel to right edge 91. However, the remaining portion 102 of this left side edge is angled to form included obtuse angles respectively with edge portion 101 and the lower edge portion of plate 90. The width of such lower edge is correspondingly less than that of upper edge 92.

That face of left plate 90 which faces the interior of the framework 10 forms a mounting surface for a projecting block 104, a pair of tracking rails 106, 108 and a pivotally interconnected lever 112. Block 104 is rectangular, relatively small and has the length thereof positioned on edge portion 102 of left plate 90 at a location sufficiently spaced above the level of bracket 96 to provide that in the inoperative position thereof, it is in a relatively adjacent spaced relation to the triggering element 103 of a normally closed signalling switch 105 that is mounted in a fixed relation to the same post surface as bracket 36, in a vertically spaced relation thereto. The operation and purpose of block 104 and this signalling device will be further described.

Each of rails 106 and 108 is formed of a length of angle iron which is L-shaped in cross-section and in its application has the shorter leg thereof providing its base. Rail 106, the dimension of which is larger than that of rail 108 in length and cross-section, has the base thereof fixed to a surface portion of left plate 90 including its edge 91 to extend substantially the length thereof from a point adjacent and spaced from the pivotal connection of plate 90 to plate 35. Rail 106 is so positioned as to dispose the projected extremity of its shorter leg slightly beyond edge 91 and establish its longer leg inwardly of and parallel to edge 91 and in an outwardly projected perpendicular relation to the surface to which it seats. Rail 108 is fixed to the same surface to similarly establish its longer leg in an outwardly projected perpendicular relation thereto, in a spaced parallel, facing and longitudinally centered relation to the longer leg of rail 106.

The upper end of rail 108 is provided with means defining an integrated extension 110 of its tracking surface 109, provided by that surface portion of the longer leg thereof which faces the parallel tracking surface of the longer leg of rail 106. The tracking surface of extension 110 is contoured to first provide a short direct vertical extension of surface 109 and then curve modestly, slope upwardly and laterally away from rail 106 in the direction of side portion 101 of plate 90 and then terminate short thereof adjacent that pivot which mounts a lever 112 to plate 90. Lever 112 has a substantially right angled configuration including a short arm and a relatively long arm the latter of which normally depends vertically from its pivot and positions the short arm to horizontally project to the left of its pivot in the direction of a line generally perpendicular to the left edge portion 101 of plate 90, relatively adjacent but spaced from its upper edge 92.

Other than for the fact that the base plate 90 to the right of screw 40 (FIG. 3) has been flipped 180° to place its edge which is identical with that designated 91 on the left plate 90 most adjacent the left plate edge 91, the assembly, detail and features shown on the interior surface of right plate 90, its interconnected parts and their interrelation with each other and framework 10 and the means and mode of the pivotal connection of this right plate 90 to the lower right corner portion of plate 35 and the connection between it and the left rear corner post 145 is identical in format with that comparable apparatus just described with reference to the plate 90 to the left of screw 40.

As may be seen in FIG. 1, a pair of plates 90' are provided to the left and right of screw 40' which are mirror images of and in a directly facing aligned relation to plates 90. Also plates 90' are positioned and related to screw 40' in the same manner as plates 90 are positioned and related to screw 40. Moreover, plates 90' are interconnected and interrelated with plate 35 and corner posts 14 and 16.

Fixed in abutment with that surface of nut 43 which faces the right side of framework 10 is the central portion of the length of a relatively elongated horizontally oriented tie bar 60, end portions 61 of which extend beyond the lateral limits of this nut. End portions 61 have the same length and configuration and each thereof is bifurcated the length thereof to define laterally spaced parallel bars bridged by an integrated cap plate C at the top edges thereof intermediate their ends, more closely adjacent to the body of the nut beyond which they project than to their projected extremities. The net effect of this construction is to provide in each of these extensions what constitutes an identical deep, coextensive groove in its bottom and a short slot in its top directed inwardly of its projected extremity. This groove is complementary to and accommodates the nesting therein of one end portion of a roller assembly support bar 62 which is pivotally interconnected to the extension 61 of the tie bar 60. As thus constructed, bar extensions 61, through the medium of their bridging cap plates C, provide limits to the pivotability of bars 62 which assures that they assume a prescribed position wherein they form a direct extension of the tie bar prior to the energization of screws 40, 40' at the commencement of each compaction cycle. Each of the bars 62 have an aperture 63 therein immediately adjacent and spaced from that end thereof remote from the tie bar, which end is bifurcated by a short horizontal radial slot 64 that intersects the aperture 63.

Fixed in abutment with that surface of nut 43' which faces the left side of framework 10 is the central portion of the length of a relatively elongated horizontally oriented tie bar 60' which includes end portions 61' for supporting roller assembly support bars 62', apertures 63' and short horizontal radial slots 64'.

The construction, features, respective positioning and interrelation and function of elements 60', 61', 62', 63' and 64' with respect to each other and to their related nut 43' and screw 40' are identical to and a mirror image of those of elements 60, 61, 62, 63 and 64 with respect to each other and to their related nut 43 and screw 40.

Figure 4:
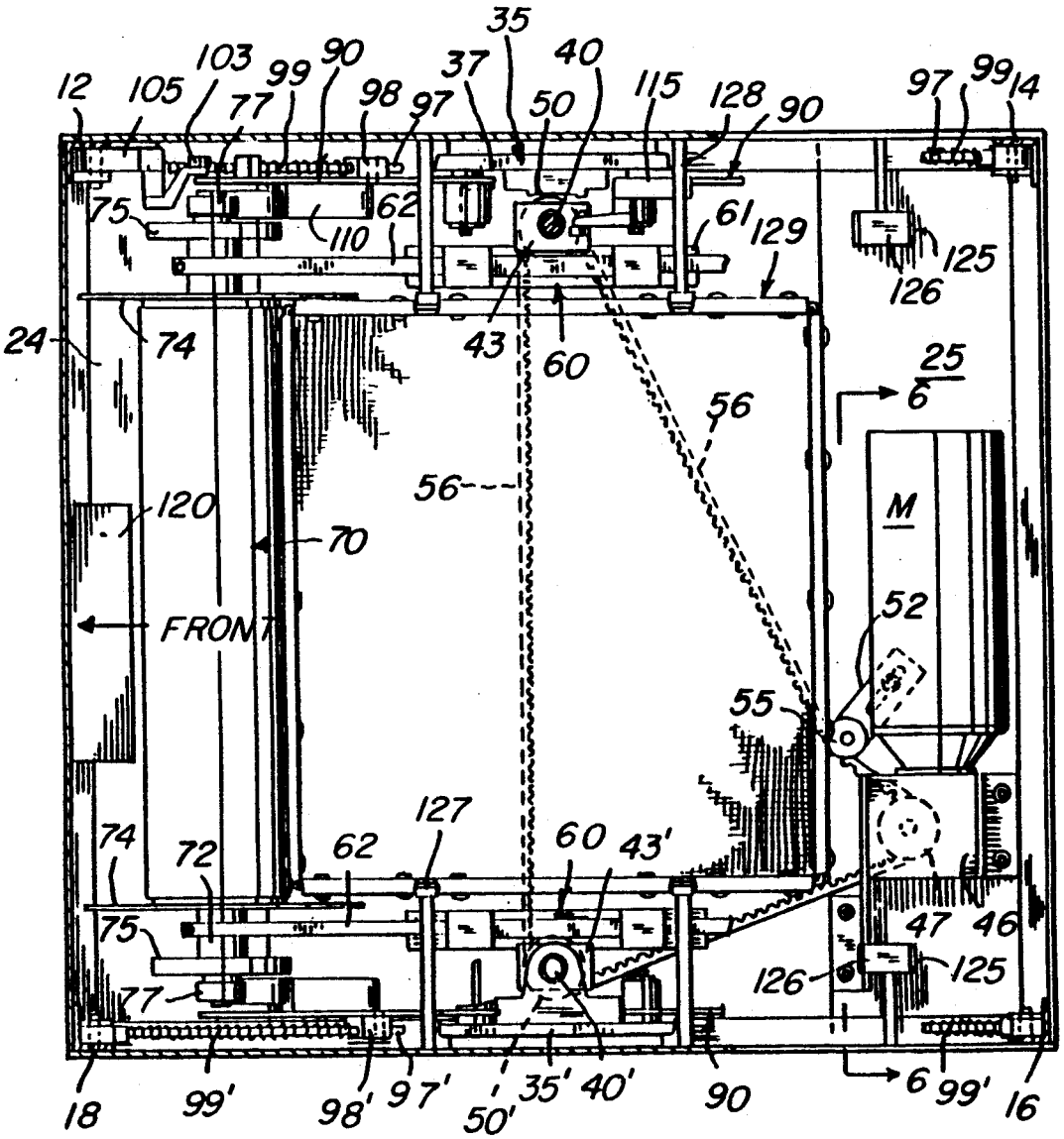
FIG. 4 is a view taken on line 4—4 of FIG. 3.

As is illustrated in FIG. 4, from side to side of the interior of framework 10 each bar 62 is aligned with and in a facing relation to a bar 62' and commonly therewith supports a roller assembly 70, by which they are bridged.

Figure 5A:
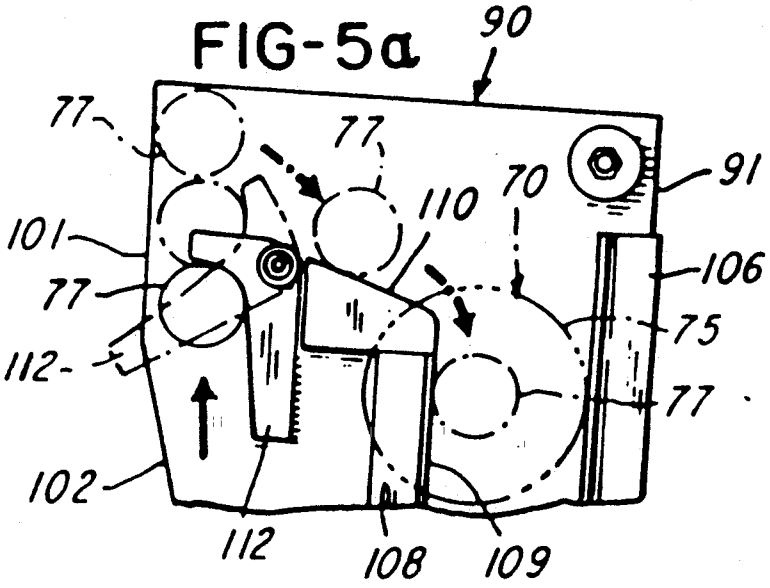
FIG. 5*a* is a fragmentary view of one of the compression plate assemblies graphically illustrating its interrelated roller assembly in the course of the completion of one cycle of the roller's operation and moving into the following cycle.
Figure 5:
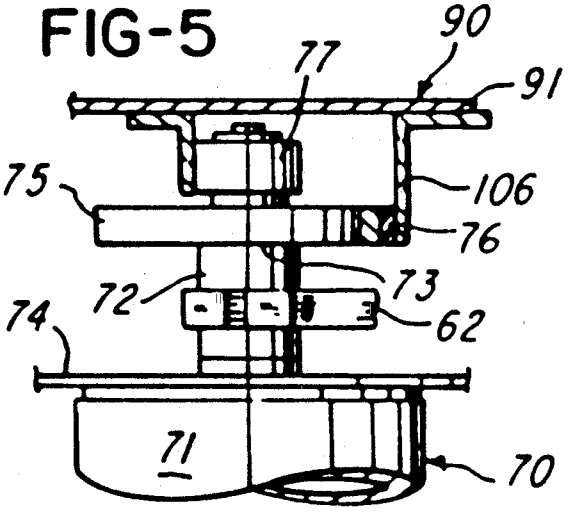
FIG. 5 is a fragmentary view of a portion of one of said roller assemblies, shown partly in section, as interrelated with its tracking plate.
Figure 6:
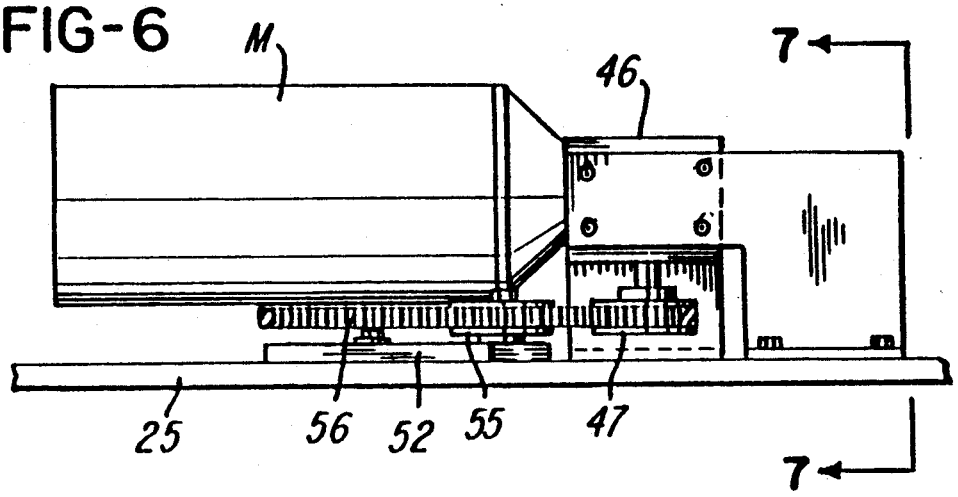
FIG. 6 is a view taken on line 6—6 of FIG. 4.
Figure 7:
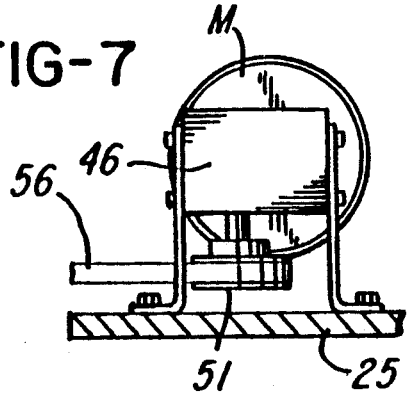
FIG. 7 is a sectional view taken on line 7—7 of FIG. 4.

Referring to FIG. 5, each roller assembly 70 comprises a hollow cylindrical drum 71 having an integrally connected coaxially projected stub shaft 72 at each of its opposite ends. Each stub shaft 72 is stepped at a point adjacent to and spaced from its projected extremity to provide thereon an outwardly facing radial shoulder 73. Peripheral to each shaft 72 and in fixed abutment to each of the opposite ends of drum 71 is a thin disk shaped plate 74. Each stub shaft 72 mounts, adjacent and in an immediately preceding relation to shoulder 73, a compression wheel 75 firmly coupled thereto and for rotation with and in a functional driving relation to drum 71 as and when required. The outer rim 76 of wheel 75 is provided with a rubber tread for traction. A metal bearing assembly 77 on the reduced diameter outer end portion of each stub shaft has one face of the inner race thereof abutted to shoulder 73 and there held by a suitable retention means applied to the outer face of said inner race.

In mounting a roller assembly 70 to and between a pair of facing bars 62, 62' at each of the opposite sides of the aligned screws 40 and 40' in each case its stub shafts 72 are respectively thrust in and extend through the aligned apertures 63 and 63' of these bars to have means defining a bearing surface provided on the stub shafts immediately of the adjacent end of roller drum 71 bear in and for rotation on and with respect to the bifurcated end portions of the pair of bars 62, 62' to which they apply. This assembly is achieved prior to the application and mount of the wheels 75 and bearing assemblies 77 to the stub shafts. In this fashion rollers 70 are positively and effectively functionally interrelated with the nuts 43 and 43' and the respective screws 40, 40' to which these nuts are threadably engaged. At the same time the nuts 43 and 43' will be positioned adjacent the upper ends of screws 40, 40' at the prescribed upper limit of their intended movements during such periods as the screws are energized for the application of the roller assemblies 70 to their intended use. This upper limit is determined by a normally closed limit switch 115 mounted on plate 35 adjacent the upper end of screw 40 (FIGS. 3 and 8).

Figure 8:
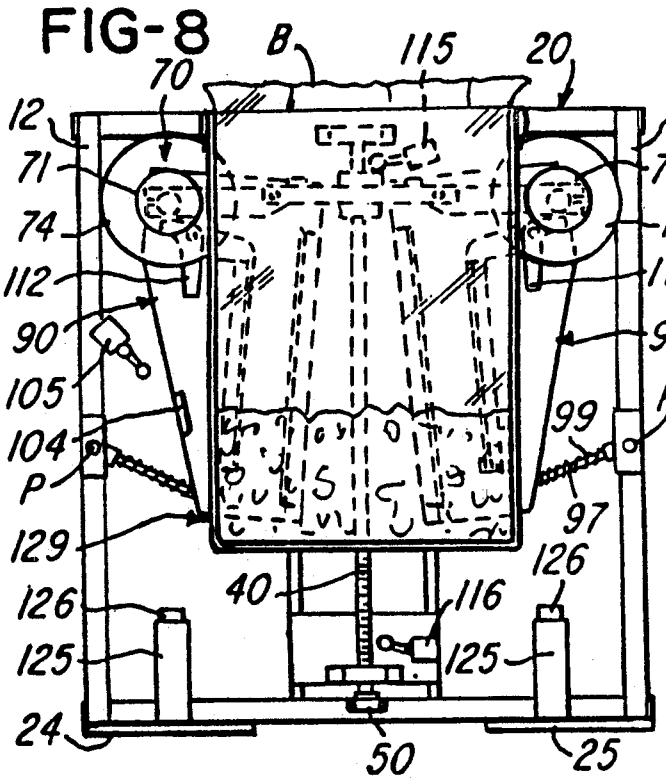

Under such conditions, seen in FIGS. 3 and 8, bars 62, 62' to each of opposite sides of the interior of framework 10 are so positioned to be horizontal and direct extensions of the tie bar to which they pivotally connect and thus the roller assemblies supported by these bar assemblies are so positioned as to have their stub shafts 72, 72' and the drive wheels 75, 75' and bearing assemblies 77, 77' which they mount positioned immediately of the facing surfaces of plate 90, 90' similarly adjacent the remote corners thereof and immediately above and laterally spaced outwardly from the upper limits of the rails 106 and 108 and 106' and 108' and the tracks therebetween at each of the opposite sides of the interior of framework 10.

Plate 36 adjacent the lower end of screw 40 mounts a normally closed limit switch 116 which determines the lower limit of travel of nuts 43, 43' during the periods when screws 40, 40' are energized.

Also positioned within the interior of framework 10, at its bottom and adjacent the rear thereof, is a reversible drive electric motor M. Motor M seats on and extends lengthwise of a central portion of the upper surface of plate 25, to which it is securely fastened. Its power transmission shaft (not shown) projects from that end thereof which is most adjacent the right side of framework 10. The projected portion of this transmission shaft is housed within a gear box 46, coupled to form a direct extension of the length of motor housing M. Within the gear box 46 the power transmission shaft of motor M is drivingly related to conventional power transmission gearing the output shaft of which projects outwardly of and depends vertically from the bottom of gear box 46 and has a drive pinion 47 securely connected to its dependent extremity. Pinion 47 is co-planar with and triangularly related to the pinions 50 and 50' which are respectively connected to the lower ends of screws 40 and 40'. Pinions 47, 50 and 50' are commonly encompassed by an endless flexible drive belt 56, teeth defined on the inner surface of which are drivingly engaged to those gear teeth which are defined on the outer peripheral surface of these pinions. Accordingly, absent a need for applying tension thereto, the configuration of belt 56, so applied, is essentially triangular.

Also fixed to the upper surface of plate 25, below and intermediate the ends of the housing of motor M, is a slotted bracket 54 (FIG. 4) which is in a relatively adjacent spaced relation to gear box 46. Bracket 52 is so angled as to have its longitudinal centerline in a direction perpendicular to that portion of belt 56 which extends between pinions 47 and 50. That end portion of bracket 52 which is adjacent belt 56 mounts a perpendicularly related pin the lowermost portion of which rotatably mounts an idler pinion 55 which is in line with the slot in bracket 52 and co-planar with pinions 47, 50 and 50'.

As illustrated in FIG. 4, in this instance pinion 55 is projected to press inwardly on and apply a tensioning bias to belt 56 at a point immediately following its movement about pinion 47. As will be obvious, conventional means may be provided to enable a selective linear adjustment of the position of pinion 47 to achieve that degree of bias which one may desire to apply to bolt 56 at any given time.

A small control box 120 mounted on and secured to plate 24 within and immediately of the front of framework 10 compactly contains that circuitry and programming interconnected and interrelated with the above described motor and switches which enables one to effect a selectively timed and time delayed control and function of the above described apparatus in accordance with the precepts of the present invention and needs of a particular application of the embodiment herein described.

Also mounted on each of the plates 24 and 25 is a pair of bumper post structures 125 the uppermost or head portions 126 of which are composed of a tough, durable resilient bumper material. These post structures on each of the plates 24 and 25 project upwardly therefrom perpendicular thereto, are respectively adjacent and equidistantly spaced from its ends, are in a paired facing relation from left to right of the interior of framework 10. In their composite the total of these posts are rectangularly positioned and the posts 125, 126 of each said facing pair thereof are so positioned adjacent, below and in an offset relation to the lower extremities of one of the two pair of facing plates 90 and 90' previously described as to commonly serve as a bumper and director for a roller assembly 70 discharging from the channel defined between the tracking rails 106 and 108 thereof. The consequence of this arrangement will be further described.

Framework 10 also incorporates, within top frame 20 thereof, a similar, rectangular, concentrically positioned frame 127 supported in a substantially spaced relation thereto by welded perpendicularly related interconnecting bars 128. Suspended from the frame 127 to depend within the interior of framework 10, centrally thereof, between and in spaced relation to the facing pairs of plates 90 and 90', substantially to the level of their lower limits, is the bottom of a draped bag 129 made of a strong durable material such as a nylon which is highly resistant to damage even when subjected to heavy loads and stress. Note that the upper portion of bag 129 rimming its mouth is provided with a series of laterally spaced parallel slits and portions thereof intermediate adjacent slits have vertically spaced complementarily formed portions of snap fasteners fixed in connection with the outermost face thereof. In dropping bag 129 into framework 10 the lower of these fastener parts are set immediately below frame 127 and that slit portion of the bag about the mouth thereof which has the upper fastener parts fixed thereto are folded back over the outer sides of frame 127 in the process of which the upper fastener parts are aligned with and snap fit to the lower fastener parts to fix bag 129 in an interconnected stably suspended relation to frame 127.

In the embodiment and application herein illustrated bag 129 is then lined with a complementarily sized conventional disposable trash bag B which will serve as a depository for compressible waste, refuse and debris in a manner to be further detailed with reference to the drawings.

The foregoing detailed description is comprehensive as to the structural configuration and interrelation of the essential parts of the illustrative embodiment of the invention shown in the accompanying drawings. The following not only demonstrates further parameters of this invention but also a practical illustration of the means and method of its use.

As pointed out above, the structure within and directly and indirectly in connection with the framework 10 immediately of the left and right sides of its interior is identical and identically arranged, except for the fact that the normally closed limit switches 115 and 116 at its left side are not duplicated at its right side. Save for the exceptions noted, the elements of this duplicated structure at one side are therefore a mirror image of and in a directly facing aligned relation to identical elements at the opposite side of the framework 10.

Furthermore, each of the two roller assemblies 70, the ends of which are supported on aligned, bifurcated extremities of facing bars 62, 62', are so mounted as to be constantly parallel, spaced from front to rear of framework 10 and have in the positioning, movements and functioning thereof an equidistant spaced relation to the screws 40 and 40' at all times.

Immediately prior to putting the illustrated embodiment into us, nut 43 will be set at its uppermost limit on screw 40, adjacent limit switch 115, at which point interconnected tie bar 60, 61 and its pivotally related extensions, namely bars 62, will be inherently constrained to assume a common horizontal attitude (FIG. 3). At the same time, since nuts 43 and 43' are at all times constrained to commonly move vertically of screws 40, 40', in tandem, at the opposite sides of the interior of framework 10, nut 43', tie bar 50', 61' and its pivotally related bar extensions 62' will be in positions which reflect mirror image relationships thereof to the corresponding parts at the left side of the framework 10. Consequently, the roller assemblies 70 will be positioned at the top of the interior of framework 10, respectively adjacent the front and rear thereof so as to have their respective stub shafts 72, 72', drive wheels 75, 75' and bearing assemblies 77, 77' similarly adjacent remote upper corner portions of the interior of framework 10 and, at each of the opposite sides of the interior of this framework, spaced outwardly of the upper limits of the rails 106 and 108 and 106' and 108' and the channels defined therebetween.

The circuitry and controls required in connection with the operation of the described embodiments are simplistic and conventionally contrived to meet the prerequisites of the apparatus thereof and its parts, the mode of interrelation of such parts and the modes of use thereof prescribed by the present invention.

The operation of the illustrated embodiment is in this case initiated by closing a normally open switch (not shown) to close a simple circuit to direct power from a conventionally available source to energize and set the prescribed direction of rotation of the motor M. The power output of motor M is applied to and through pinion 47 to the power transmission belt 56, which resultantly powers and commonly drives pinions 50 and 50' and thereby causes screws 40 and 40' to synchronously rotate in place, in their prescribed direction. This induces movement of nuts 43 and 43' and their interconnected tie bars, in tandem, in a direction downwardly of screws 40 and 40'. Nuts 43 and 43' have clear paths enabling their continuous movement downwardly of framework 10 between plates 90, 90 and 90', to the extent permitted by limit switch 116.

Figure 9:
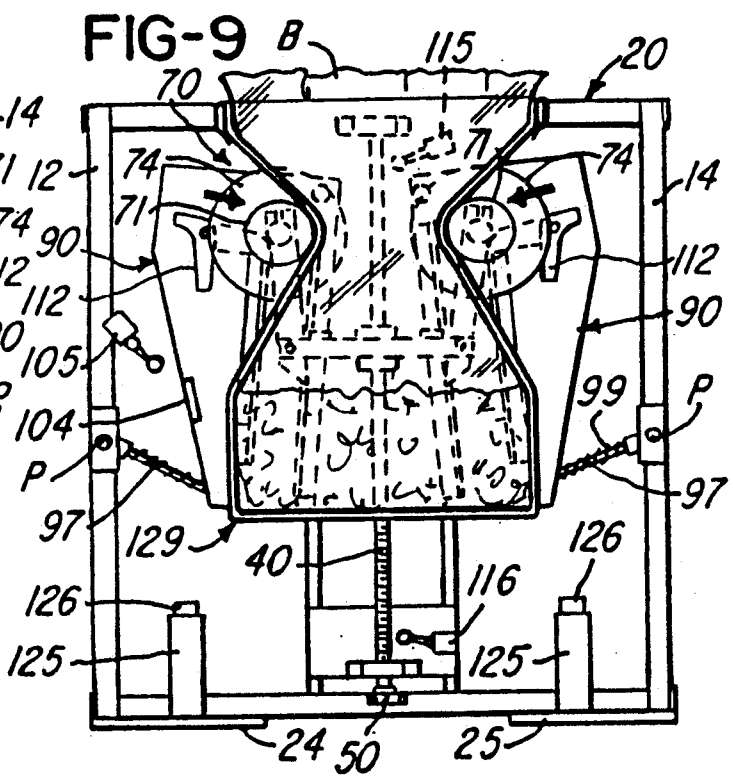
FIGS. 8–13 portray a number of illustrative cycles of operation of the herein described compression and compacting apparatus during a period of the energization thereof and highlight the means and mode of the application thereof to a conventionally fabricated relatively thin flexible disposable bag nested in an outer much more durable bag during the course of a continuing introduction to the inner bag of compressible waste, refuse and debris.

By reason of the construction and arrangement of plates 90 and 90' and the assemblies of which they form a part, the rate of downward movement of bearings 75, 75' and compression wheels 77, 77' of roller assemblies 70 and 70' is initially more limited than that of nuts 43, 43'. As will be seen in FIG. 3, at their uppermost or cycle start positions bearings 75, 75' are respectively directly above the uppermost surface portions of the short arms of levers 112, 112', from which points they must move laterally inward to, over and downwardly of the upper tracking surface portions 110 of rails 108, 108' before they can reach the upper limits of the substantially vertical portions 109, 109' of their tracking surfaces. The larger diameter compression wheels 77, 77' do not come into contact with their tracking surfaces, which are provided by rails 106, 106', until such time as bearings 75, 75' reach the portions 109 and 109' of their own tracking surfaces, by which time nuts 43, 43' will have reached a level in framework 10 which is in the vicinity of the level of the mid-point of the length of the flanking edges 91 and 91' of plates 90 and 90', and the bar extensions 62, 62' will have been caused to so pivot that they have assumed positions which are close to vertical (FIG. 9).

As the roller assemblies 70 and 70' are moved into a full tracking relation to rails 106, 106', the drum portions 71, 71' thereof simultaneously move into an opposing pressured contact with and apply an inward bias to opposite side portions of bag means 129 and correspondingly its inner bag B. The degree of this inward bias is such to substantially restrict the interior cross-section of bag B and produce a throat in the length thereof at a point therein the distance of which from the mouth thereof is about 20% of its length. At the same time that this occurs, plates 74 at the ends of the drums 71 mutually move into a containing and stabilizing relation to the bag means to maintain its attitude within and the spacing thereof from the framework 10 and the apparatus which this framework mounts in its interior. As will be obvious, the advantages of this stabilizing effect is preserved as drums 71, 71', by virtue of their support by and connection to nuts 43, 43', are caused to continue their movement down respectively opposite side portions of the bag means mutually to serve their compressing and compacting function on whatever the contents of the inner bag thereof may be until they clear the bottom of bag 129.

A non-obvious feature that presents itself, as and when the rubber treads 76 and 76' of wheels 77, 77' contact and are brought into frictional engagement with their tracking surfaces, is that these wheels 77 are thereby caused to counter-rotate such that they provide a modest lifting influence on the bag 129 and its contents sufficient to avoid undue stress and/or strain thereon during the compressing and compacting functions of the roller assemblies 70 and 70' in each cycle of the operation thereof. This insures a long operating life for the bag 129, and minimizes maintenance procedures necessary in connection therewith and contributes to the integrity of the bag suspension means and together with the plates 74, 74' lends unusual stability to the bag means during all compressing and compacting of its contents.

Departing briefly from the description of the operation of the present invention, it must be understood that once the operation of the invention apparatus is started, unless it is otherwise deliberately or accidentally shut down, it will continue, as will be seen, until the content of the material deposited and compacted in the bag B reaches such a limit as to itself trigger a shut down, at which time all elements of the system and apparatus of the invention will automatically return to and remain in their originally set positions until they are once more energized, at which point they will interrelate and interfunction in the same manner in the first period of their operation. Another point of interest is that the programming of the controls and circuitry utilized (not illustrated) to govern the operation of the embodiments of this invention include means which can be preset to produce a time spaced reenergization of the invention apparatus following each shut down thereof as well as to provide for automatic timed spaced periods of their operation. This makes possible a highly economical and highly versatile usage and application of embodiments of the present invention on the premises of their users.

Thus, given the commencement of the operation of the described embodiment when there is a minimal disposal of waste, as the roller assemblies 70 and 70' are moving into a full tracking relation to rails 106, 106' and the drum portions 71 thereof simultaneously move into an opposing pressured contact with and apply an inward bias to opposite side portions of bag means 129 and correspondingly its inner bag B to produce the aforementioned substantially restricted cross-section of bag B, the content of bag B will be sparse. Therefore, immediately following and during the entire period of the movement of the opposed drum portions 71 and 71' downwardly of the respectively opposite side portions of the bag means to and past its bottom, the space therebetween will only slightly vary from that which produced the aforesaid original restriction and there will be little, if any, compressing and compacting function on whatever the contents of the inner bag thereof may be at that time.

At that point in time that drums 71, 71' proceed to clear the bottom of bag 129 in the continuation of the downward movement of the assemblies of which they form a part, whether it be in the first or any succeeding cycle of their continuing function, bearings 75, 75' will then clear the rails 108, 108' and in immediately following relation thereto wheels 77 and 77' will clear their respective tracking surfaces and the rails 106 and 106' by which they are provided.

While bearings 75 and 75' freely rotate during their function, the friction inducing nature of the treads of wheels 77 and 77' as they make contact with their tracking surfaces, respectively provided by rails 106 and 106', as noted previously, produces a positive and continuing counter-rotation of these wheels as they engage and move downwardly of such surfaces. Accordingly, in clearing the lower ends of their tracking surfaces, aided by the modest inclination of such surfaces in the direction of the respectively adjacent sides of framework 10 and the immediately preceding clearance of bearings 75, 75' from tracking surfaces 109 and 109' thereby providing relief of any further element of support thereof by the facing assemblies on which they form a part, the support bars 62 and 62' to which they are linked, under the influence of gravity, kick laterally outward and downward from and clear of the respective control plates 90 and 90'. By virtue of the dimension and relative placement of the involved parts, as nuts 43 and 43' move to their lowermost limits on screws 40 and 40', as determined by the contact of nut 43 with switch 116, each roller assembly moves in a path which is interrupted by its contact with and seat to the heads 126 of a facing pair of the bumper posts 125. This seating of the roller assemblies is coincident with that moment that nut 43 contacts and opens normally closed switch 116 as a result of which to deenergize the motor M, close a circuit to actuate an interrelated timer, which after a momentary time delay triggers the closing of a circuit from power to the motor M which incorporates means to produce a reverse drive of screws 40 and 40' and a simultaneous gradual upward movement of nuts 43 and 43'

Figures 12, 13:
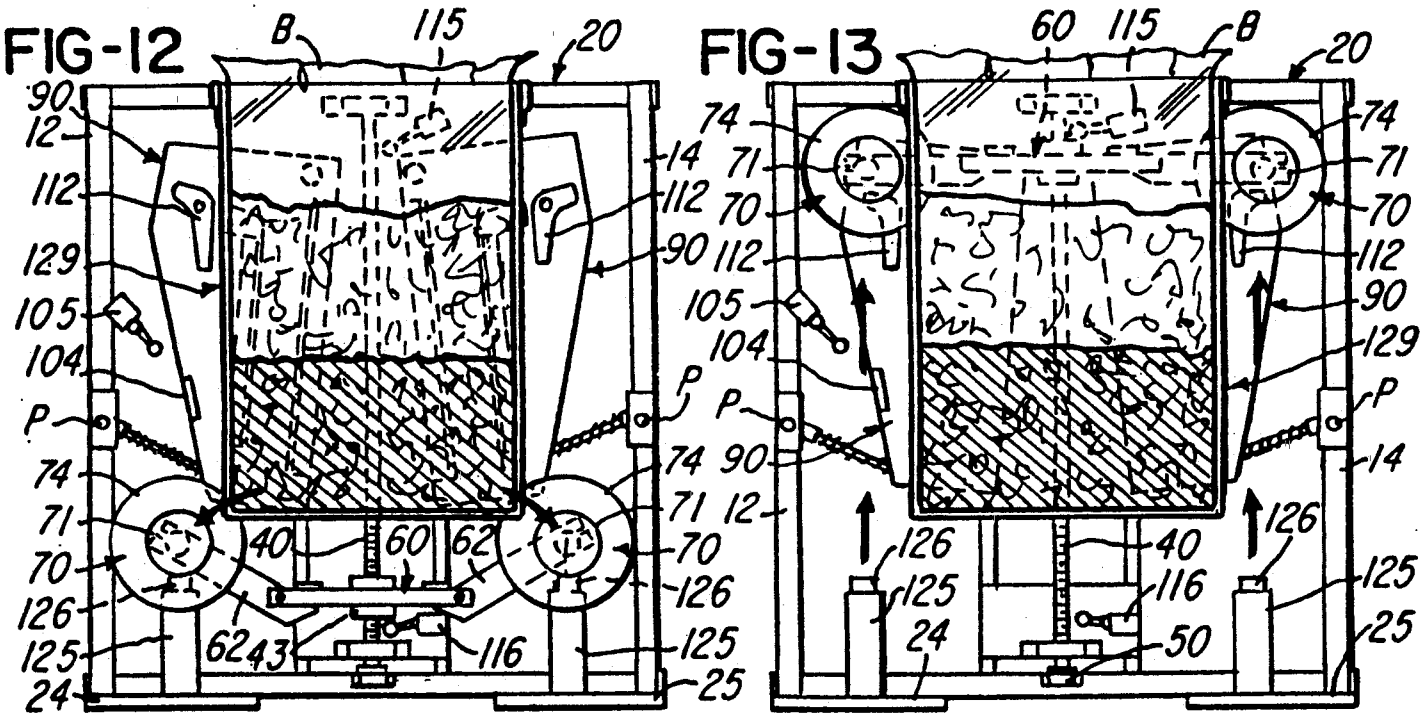
Figure 14:
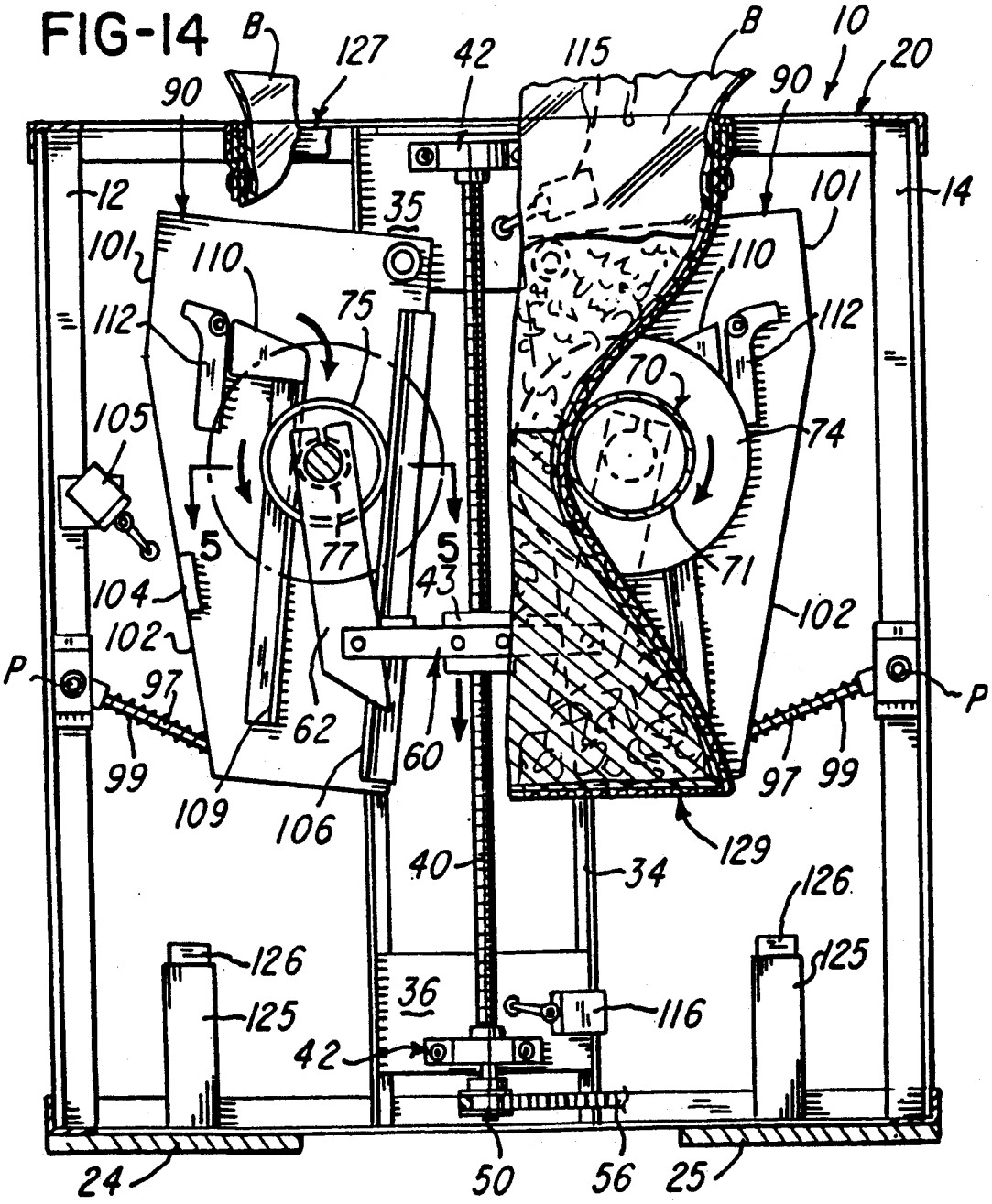
FIGS. 14 and 15 are enlarged views further demonstrating phases of the operation of the compressing and compacting apparatus of the illustrated embodiment at such time the disposable bag shown in FIGS. 8–13 approaches and reaches its full capacity of waste, refuse and debris compacted in accordance with the present invention.
Figure 15:
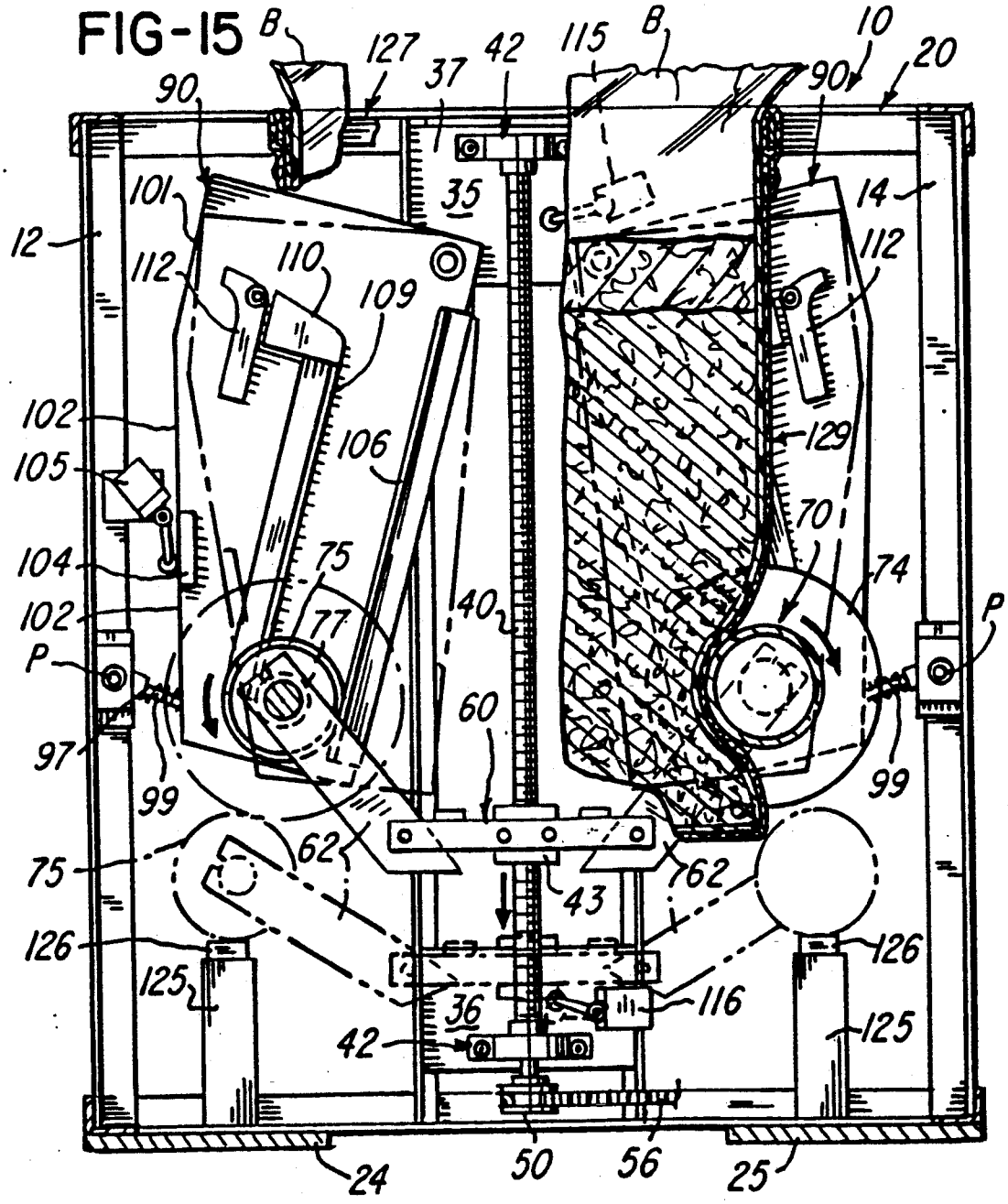

During that brief interval of time, roller assemblies 70 and 70' are seated to the bumper heads 126, nuts 43, 43' are at rest at their lowermost limits the level of which is below that of the bumper heads. As a result thereof, bars 62 and 62' which pivotally link the roller assemblies to their tie bars are then upwardly divergent (FIG. 12). Once the upward movement of nuts 43, 43' commences, bars 62 and 62' are gradually lifted therewith and quickly brought into positions wherein they are horizontally disposed and once again form direct extensions of their tie bars. When this occurs, roller assemblies 70 and 70' are laterally displaced from and outwardly of the bumpers 125, 126 to remote points within and respectively adjacent the front and rear portions of framework 10. As so positioned, roller assemblies 70 and 70' are each provided with a path for their vertical movement to the top of the interior of framework in concert with and by means of the continued vertical movement of nuts 43 and 43', this path being clear except for the interposition therein of the short arms of levers 112 and 112'.

Attention is directed to FIG. 5*a* which displays the fact that in the course of the upward movement of the roller assemblies 70 and 70' their roller bearings 77 and 77' respectively encounter the short arms of levers 112 and 112' immediately prior to reaching their uppermost positions in the framework 10 and in the process thereof flip them out of their way in a manner enabling them to clear these levers and position immediately thereabove, once more at the very top of the interior of framework 10. As the roller assemblies 70 and 70' move into their uppermost positions in framework 10, nut 43 reaches its upper limit and in the process thereof engages the normally closed switch 115 resulting in the opening of a circuit directing power to motor M and the closing of a circuit to actuate an interrelated timer, which after a momentary time delay triggers the closing of a circuit from power to the motor M which incorporates means to once more produce a reverse drive of screws 40 and 40' and initiate a second cycle of operation of the illustrated apparatus of the invention. The second and each succeeding cycle thereafter may differ from the pattern of that of the first in accordance with the differences of the amount and condition of the deposit of waste, refuse and/or debris in the bag means 129, B at the time thereof. This will be described in some detail with reference to the illustrative FIGS. 8–18 of the accompanying drawings.

To insure a clear understanding of significant features of the invention including the loop type cycling of the roller assemblies 70, it must be kept in mind that the construction and arrangement of roller assemblies 70, 70' and their controls are basically established in the first instance. The elements of the roller assemblies and their controls embodied in and interrelated to the plates 90 and 90' and framework 10 is such that the drums 71, 71' will in no instance move closer than a distance of five inches apart. This precludes injury to a user who might accidently or inadvertently thrust a hand or arm inwardly of the mouth of bag B. Note should also be taken of the fact that the natural and normal basic pattern of movement of the opposed drums 71, 71' of the roller assemblies is slightly divergent as they move downwardly of the length of bag means 129, B. This divergency is dictated by their interrelation with and control imposed thereon by the tracking surfaces of rails 106 and 108, 106' and 108' which at opposite sides of the interior of framework 10 diverge in an amount of 3° to 5° from a vertical.

As to further cycling of the apparatus of the invention given the foregoing parameters let us now consider a situation wherein, as shown in FIG. 8, there has been some deposit in a lower end portion of bag B at which time the second cycle of operation of the illustrated apparatus is triggered. Under such circumstances, as shown in FIG. 9, when the roller assemblies through the medium of their drum 71 and 71' move inwardly of the bag means and form a restrictive throat in the interior of bag B adjacent and spaced from the mouth of the bag the drums will not approach any closer than a distance of five inches apart and thereafter, as they continue their movement without break, they follow their originally designed pattern wherein they gradually and slightly separate as they move downwardly the opposite sides of the bag means and maintain this pattern until they reach the level of the waste, refuse and debris which has been to this point deposited in the dependent portion of bag B at the bottom of its interior.

Figures 10, 11:
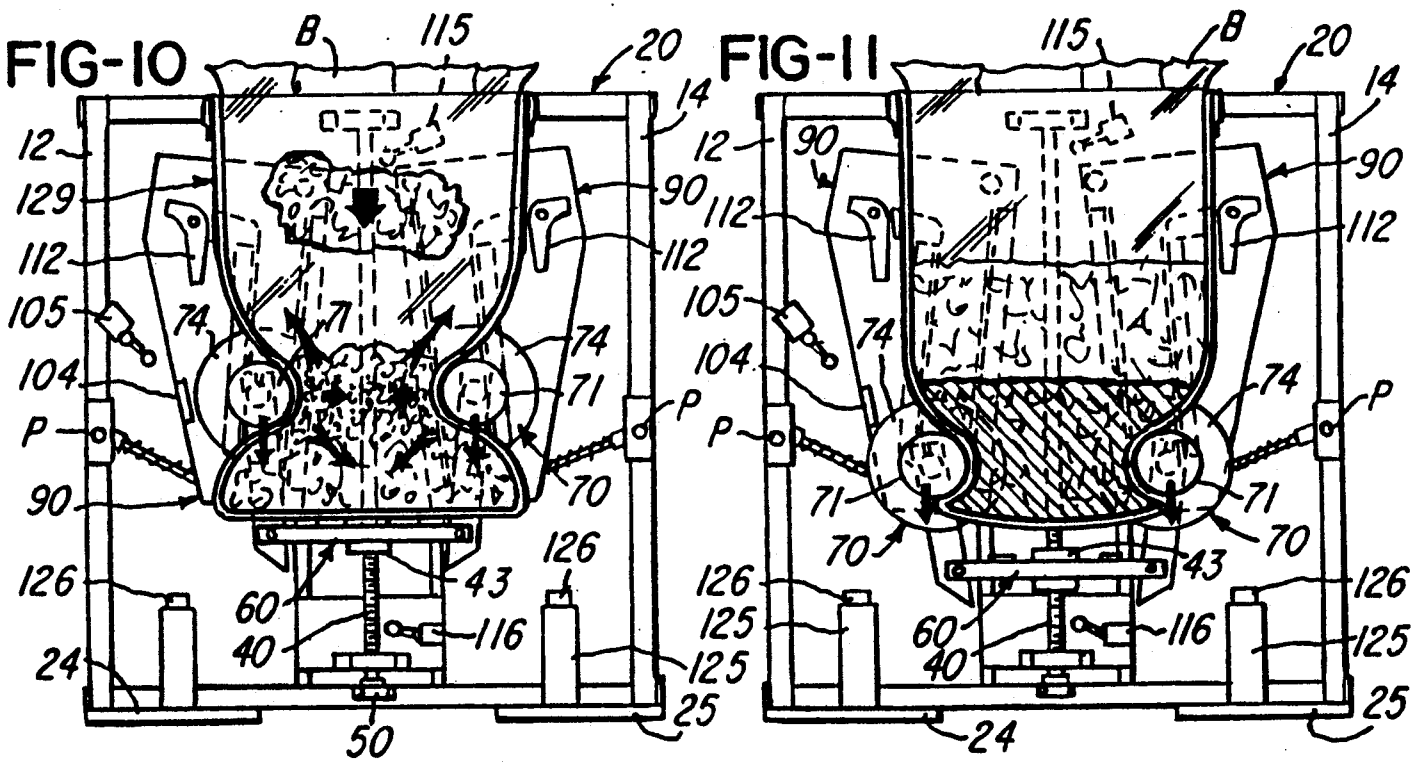

FIG. 10 exhibits additional deposit and disposal of refuse and more significantly what occurs when the drums reach the level of the previously deposited refuse. Due to the counter-rotation of drums 71, 71' under the influence of wheels 75 the drums not only apply a directly lateral compressing force to this refuse but at the same time apply downwardly, angularly inward and angularly upward components of force thereto which produces not only a degree of compression reduction of material but also some initial compaction thereof and also at the same time drives air and liquid entrapped in the waste, refuse and debris in bag B upwardly through the central core so that air might escape from the bag B by way of the mouth thereof.

FIG. 11 does not necessarily illustrate an immediate following cycle but one subsequent thereto. What it illustrates is that having achieved the maximum possible restriction of the interior of the bag B at a point approximately 1/5 of the framework 10 as the wheels 75, 75', and bearings 77, 77' move downwardly of the channels defined by the facing surfaces of rails 106 and 108 they gradually, very slightly separate as long as they find no resistance or interference in the nature of outward bias thereon by materials dropped into the interior of the bag B. As and when they do come within the level of that material which has been previously deposited in bag B, for example as seen in FIG. 10.

Each of the FIGS. 8–13 show various stages of filling of the bag B and the results of successive cycles of the apparatus of the invention during each of which, in succession, a greater and greater degree of compression and compaction is applied to the originally deposited materials and successively deposited materials as the bag continues to be filled.

Figure 16:
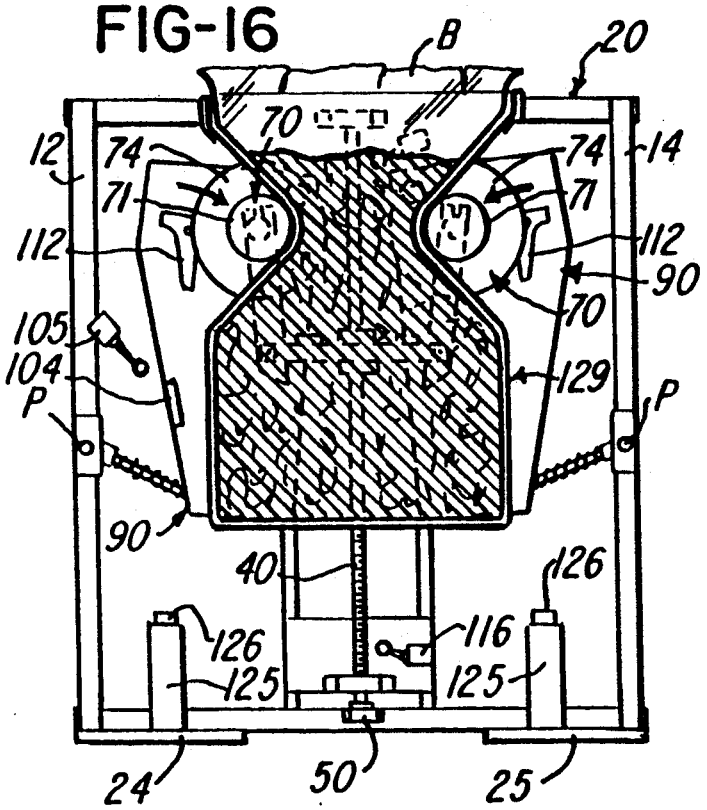
FIGS. 16–18 are views which graphically portray the ensuing results of a series of cycles of compression and compacting such as shown and applied in FIGS. 8–15.
Figure 17:
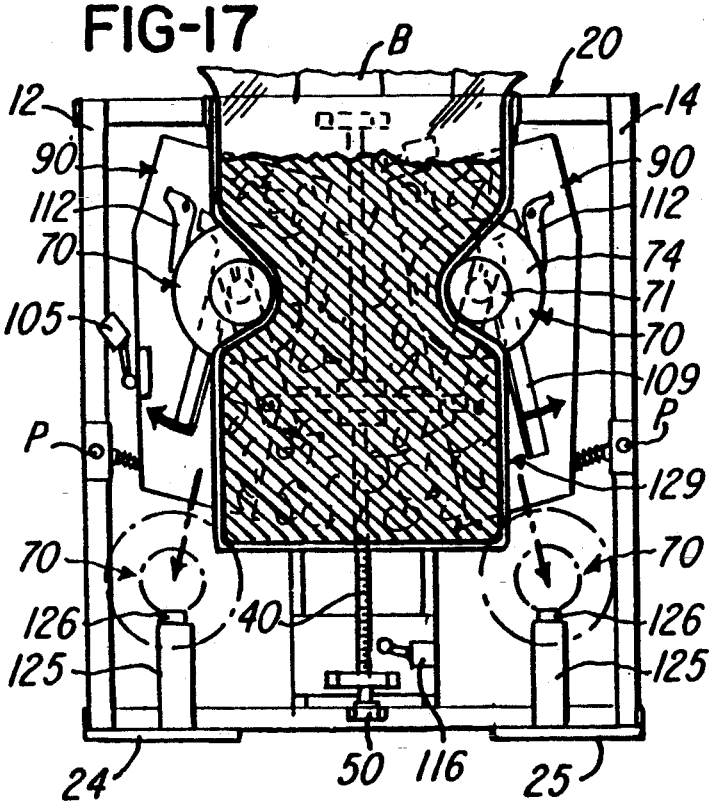
Figure 18:
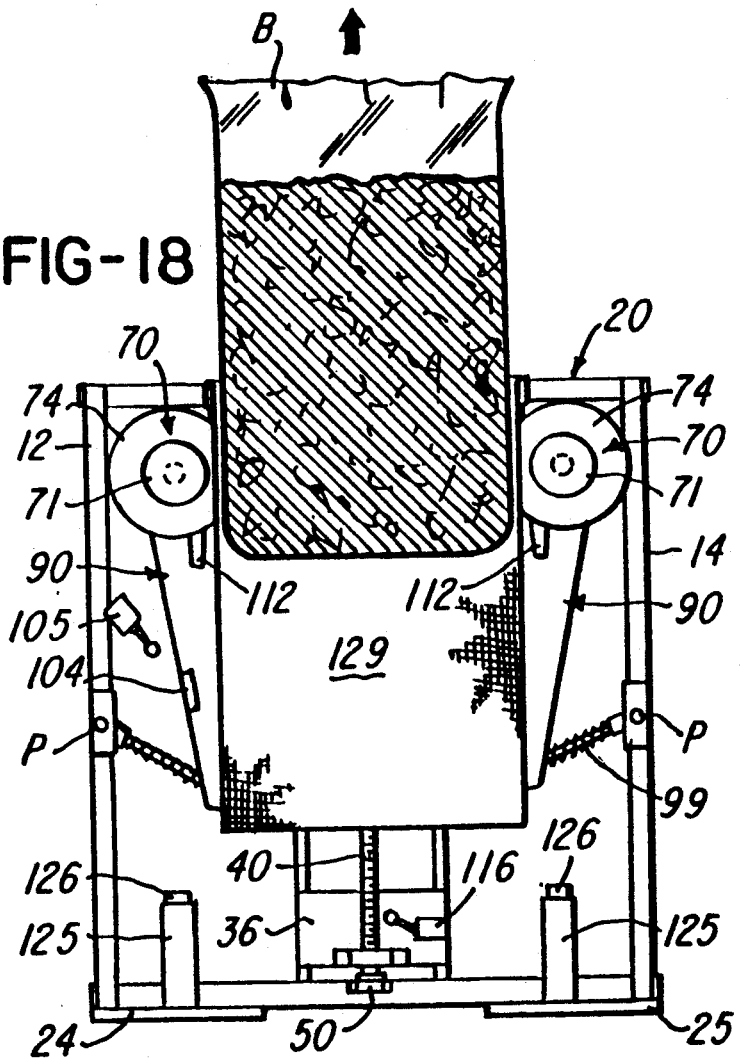

It is to be understood that the various FIGS. 8–18 are presented in a fashion to emphasize the various conditions that might exist during a period of energization of the invention apparatus herein illustrated and the various facets and import of this successive cyclic application of the roller assemblies and the drums thereof to the gradually increasing amounts of refuse which may be deposited over a period of time in the bag B. Each cycle lends a compression and compacting influence on the contents of bag B once there has been a deposit therein of a modest amount of refuse with a continuing action that occurs. By the time the condition as shown in FIG. 16 occurs there has been so much compaction and compression, breaking down and further compaction of the contents of the major portion of the length of bag B that the refuse within the bag is applying a resistant bias to and against the roller assemblies and through them to the rails on the plates 90 and 95 to the point they apply a sufficient bias to these rails and plates to cause the plates 90 and 90' to pivot laterally outward against the bias of springs 99 sufficiently to cause the block 104 on plate 90 to come into contact with the trigger element of the switch 105 which signals a completion of the filling of the bag in a time delayed relation and causes as the nut 43 comes up to and hits the switch 115, at such time as the roller assemblies return to their starting position which produces a complete shutdown of the operation of the embodiment of the invention. There will be no further recycling thereafter until the apparatus has had the bag therein replaced and is provided with a signal to commence another time period of operation with respect to materials deposited in the replacement bag. The second time period of energization will be completely automatic as was the first.

In summary, prior to installing an embodiment such as illustrated, a determination will be made as to what may be the busiest times of each day of business as well as the lightest periods of the day and the controls included in connection with this embodiment will be so programmed to provide for cycling the operation of the compressing and compacting apparatus thereof raw predetermined spaced intervals the length of which is based on the amount of business normally anticipated over a selected period of time.

The efficiency of the invention is additionally demonstrated by the fact that each bag which is packed thereby is enabled to end up with a load so highly compacted which is greater than that load which the disposable bag B could accommodate under normal circumstances.

It must be emphasized that once the operation of the invention apparatus is started, unless it is otherwise deliberately or accidentally shut down, it will continue, as will be seen, until the content of the material deposited and compacted in the bag B reaches such a limit as to itself trigger a shut down, at which time all elements of the system and apparatus of the invention will automatically return to and remain in their originally set positions until they are once more energized, at which point they will interrelate and interfunction in the same manner as in the first period of their operation. Another point of interest is that the programming of the controls and circuitry utilized (not illustrated) to govern the operation of the embodiments of this invention include means which can be preset to produce a time spaced reenergization of the invention apparatus following each shut down thereof as well as to provide for automatic time spaced periods of their operation.

An alternative embodiment of the present invention is shown in FIGS. 19–32 in which elements corresponding to elements in the first embodiment are designated by the same numeral as that used for the first embodiment increased by 200.

Figure 19:
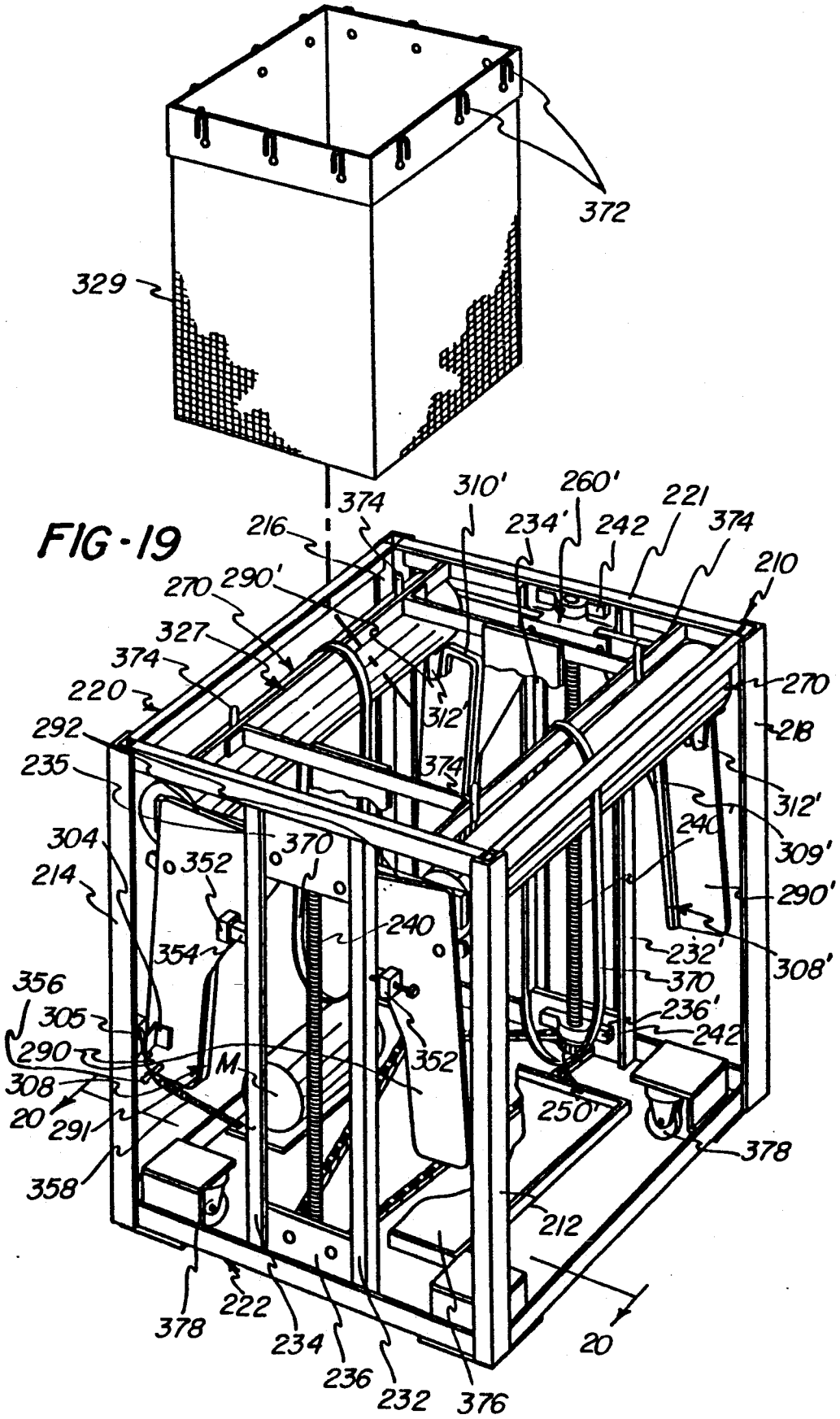
FIG. 19 is a partially exploded perspective view of a second embodiment of the present invention.

As may be seen in FIG. 19, the compactor of the second embodiment includes a frame 210 supporting a pair of screws 240, 240' for rotation whereby a pair of tie bars 260, 260' are driven vertically in the same manner as in the previous embodiment. It should be noted that the tie bars 260, 260' of the present embodiment are different from the previous embodiment in that the bars 260, 260' no longer are provided with a nut and instead include an aperture which is threaded for engaging a respective screw member 240, 240'.

Figure 20:
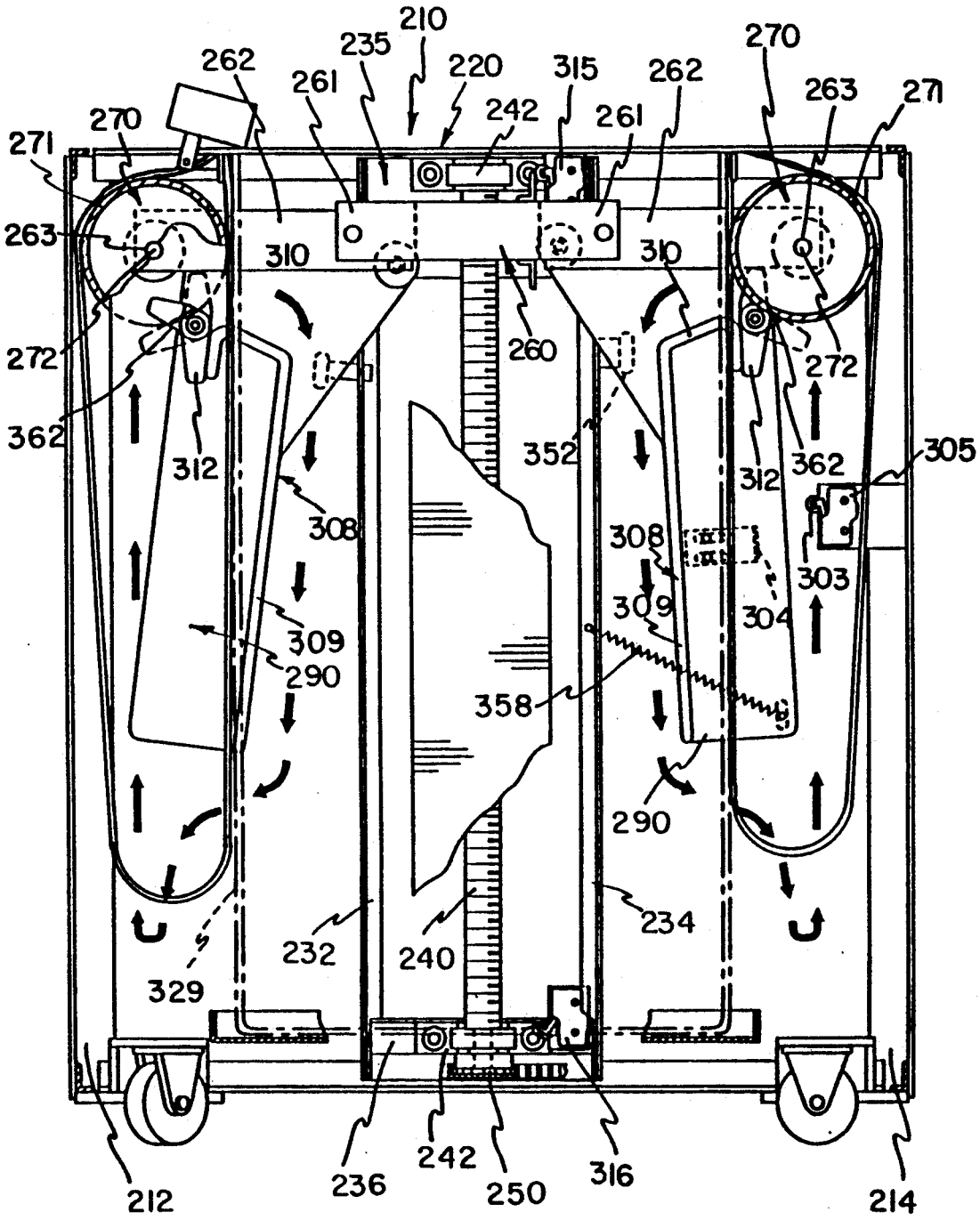
FIG. 20 is a view taken along line 20—20 in FIG. 19 showing the compression rollers located at an upper portion of the apparatus subsequent to the completion of a cycle.
Figure 21:
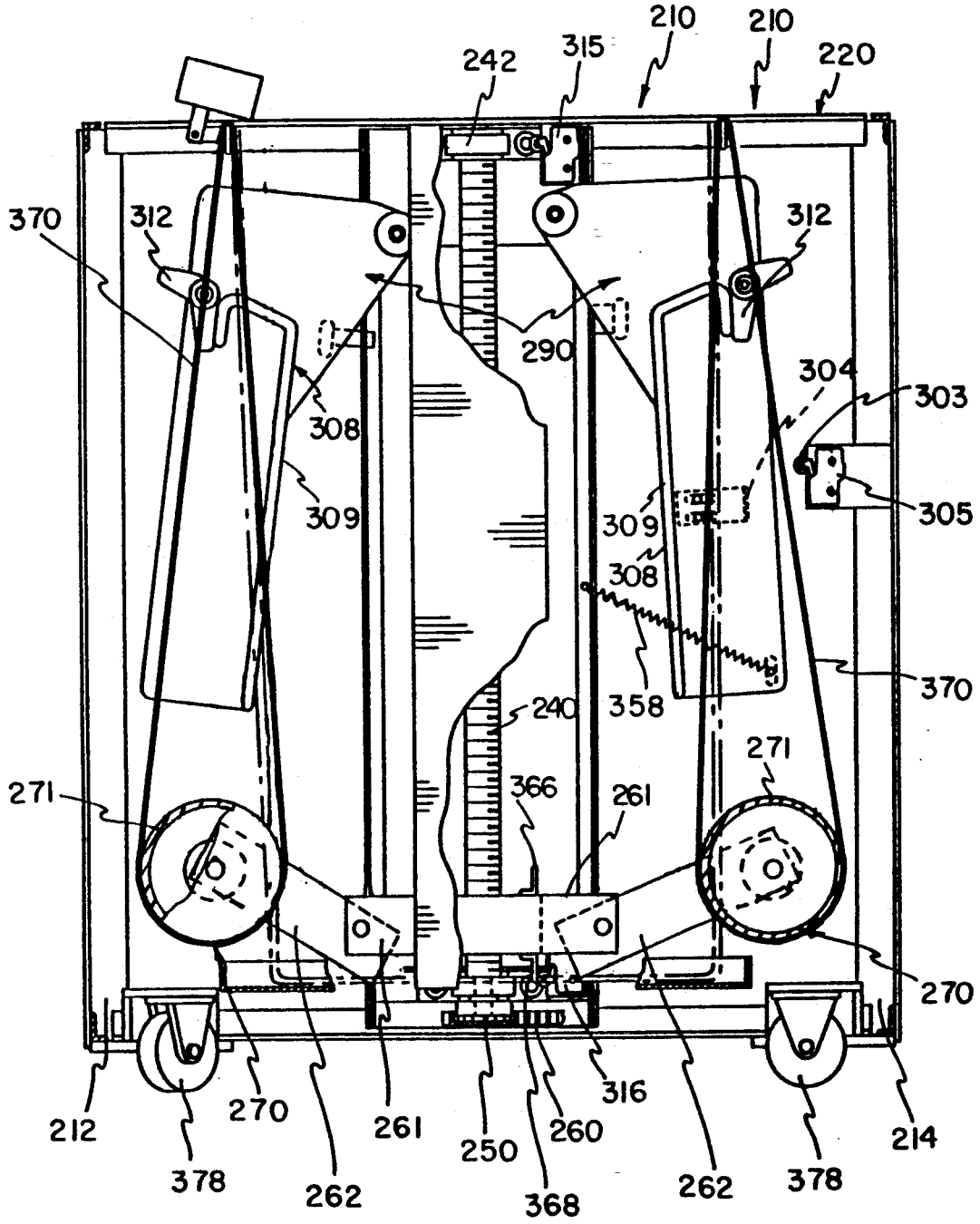
FIG. 21 is a view similar to FIG. 20 in which the compression rollers are shown located in a lower portion of the apparatus subsequent to a compression phase of the cycle.

Compression plate assemblies 290, 290' are provided mounted to the compactor at attachment points 350, 350' located on plates 235, 235'. It should be noted that of the four plates 290, 290', the two located at the rear portion of the apparatus, i.e., the right-hand plate as seen in FIGS. 20 and 21, are mounted for pivotal movement about the attachment points 350, 350' whereby the attachment points 350, 350' form pivot supports for allowing the rear plates 290, 290' to pivot outwardly from a central portion of the apparatus as in the previous embodiment.

Referring to FIGS. 19–22, each of the plates 290, 290' is provided with an outwardly extending finger member 352, 352'. The finger members 352, 352' on the rear pivoted plates 290, 290' engage a bumper member 354, 354' to limit inward movement of the rear plates 290, 290'. The fingers 352, 352' located on the plates 290, 290' at the front of the apparatus are rigidly affixed to respective vertical frame members 232, 232' by means of a bolt whereby the front plates are prevented from pivoting.

The plates 290, 290' located at the rear of the apparatus are further provided with an outwardly extending projection 356, 356' and a tension spring 358, 358' extends from respective projections 356, 356' to the vertical frame members 234, 234'. The springs 358, 358' provide a tensioning force on the rearwardly located plates 290, 290' to bias these plates toward the center of the apparatus.

Each of the plates 290, 290' are further formed with a guide rail 308, 308' corresponding to the guide rails 108, 108' provided in the previous embodiment. The rails 308, 308' engage a bearing mounted wheel 277, 277' (see FIGS. 23 and 24) for biasing a roller 271 of a roller assembly 270, 270' inwardly toward the center of the apparatus. It should be noted that in the present embodiment the roller 271 is mounted for free rotation in contrast to the previous embodiment in which a second rail was provided in order to drive the rollers in counter-rotation as they were moved downwardly through the apparatus. Thus, in the present embodiment the inner rail has been eliminated and only one rail 308, 308' has been provided for providing an inwardly directed force to the rollers 271.

The plates 290, 290' are preferably formed as a single casting from a lightweight material such as aluminum, and the guide rails 308, 308', fingers 352, 352' and extensions 356, 356' are also preferably formed with the body portion of the plates 290, 290'.

Figure 22:
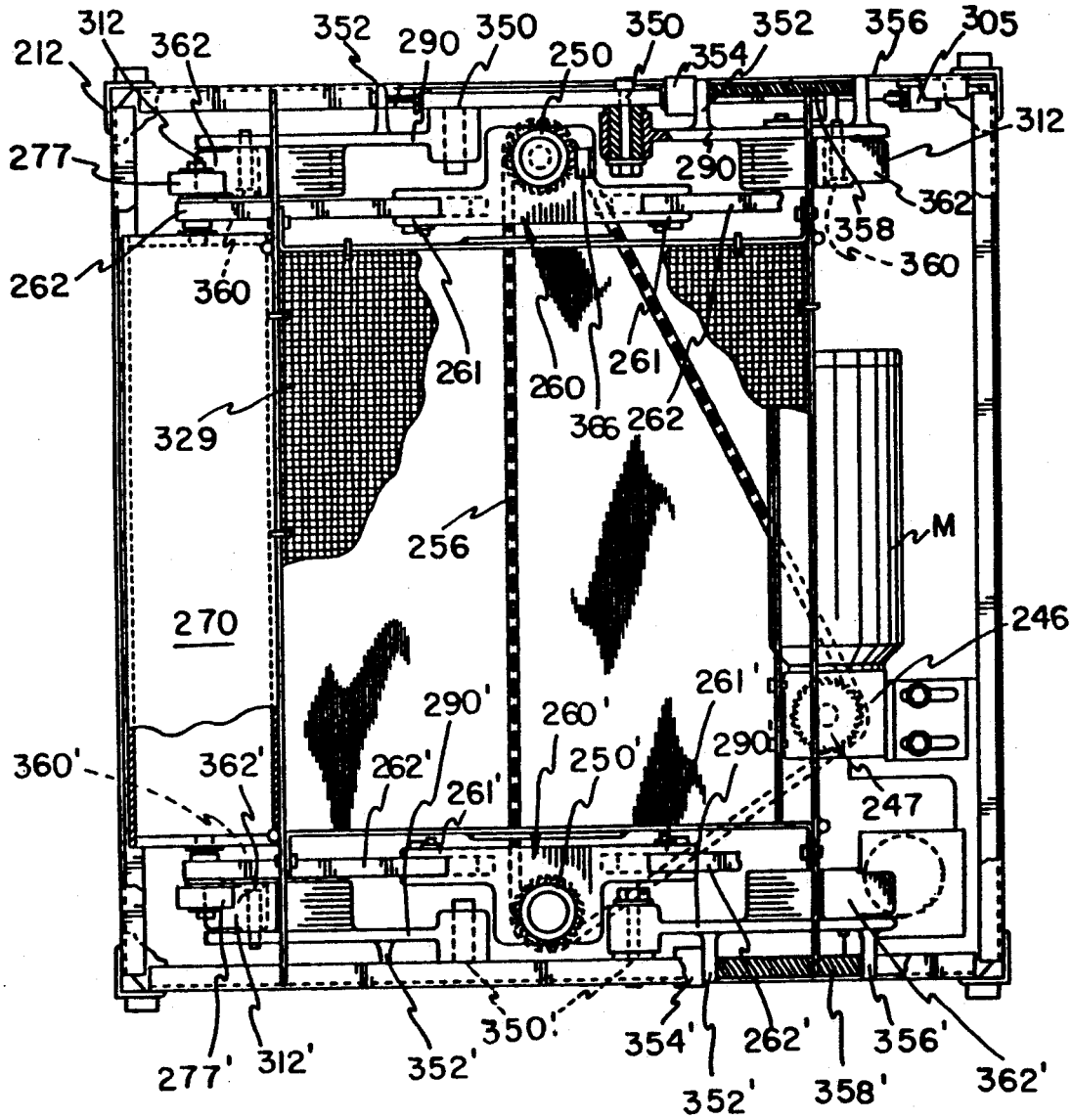
FIG. 22 is a plan view of the apparatus of FIG. 19 in which one of the compression rollers and a portion of its supporting structure is removed.
Figure 23:
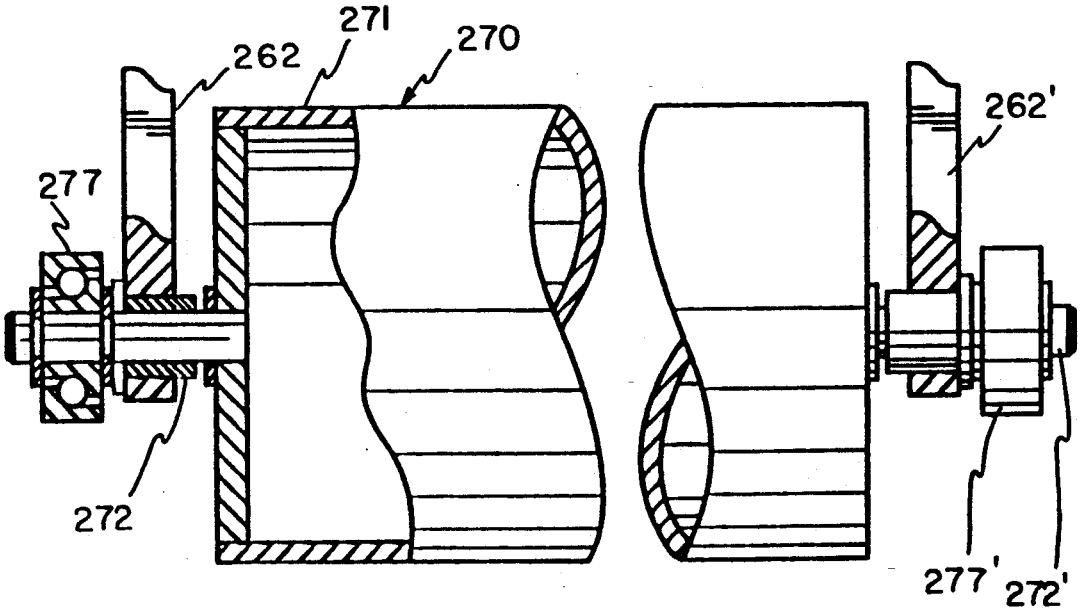
FIG. 23 is a view of a compression roller assembly of the second embodiment partially in cross-section.
Figure 24:
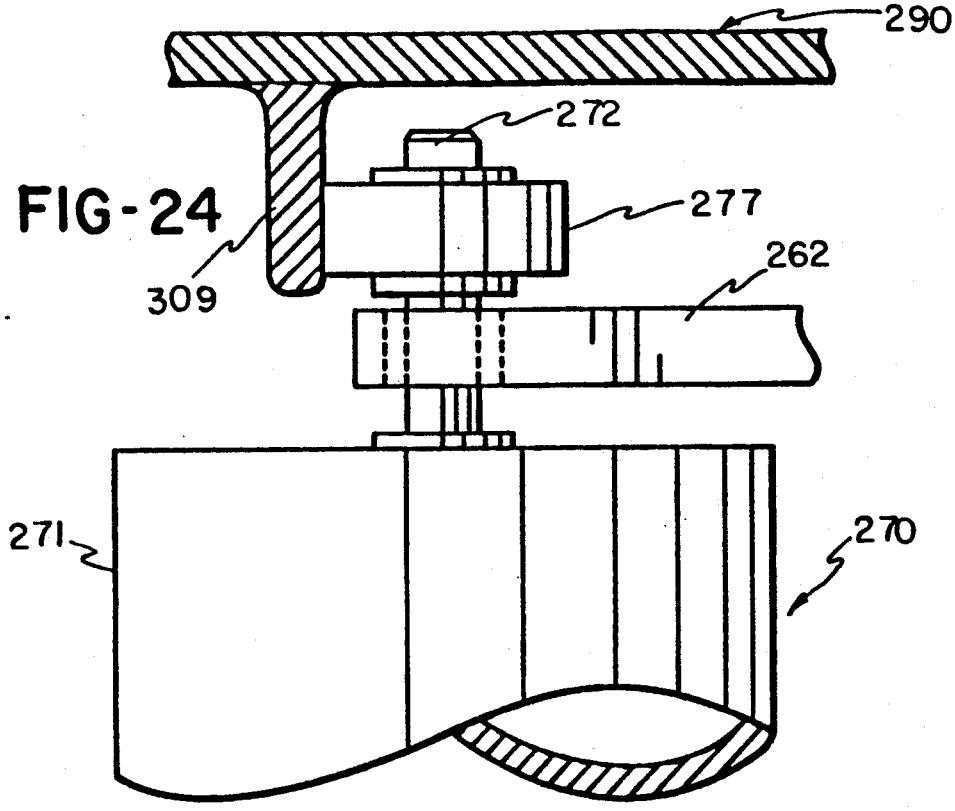
FIG. 24 is a view showing a bearing wheel of the roller assembly of FIG. 23 in cooperation with a guide rail.
Figure 25:
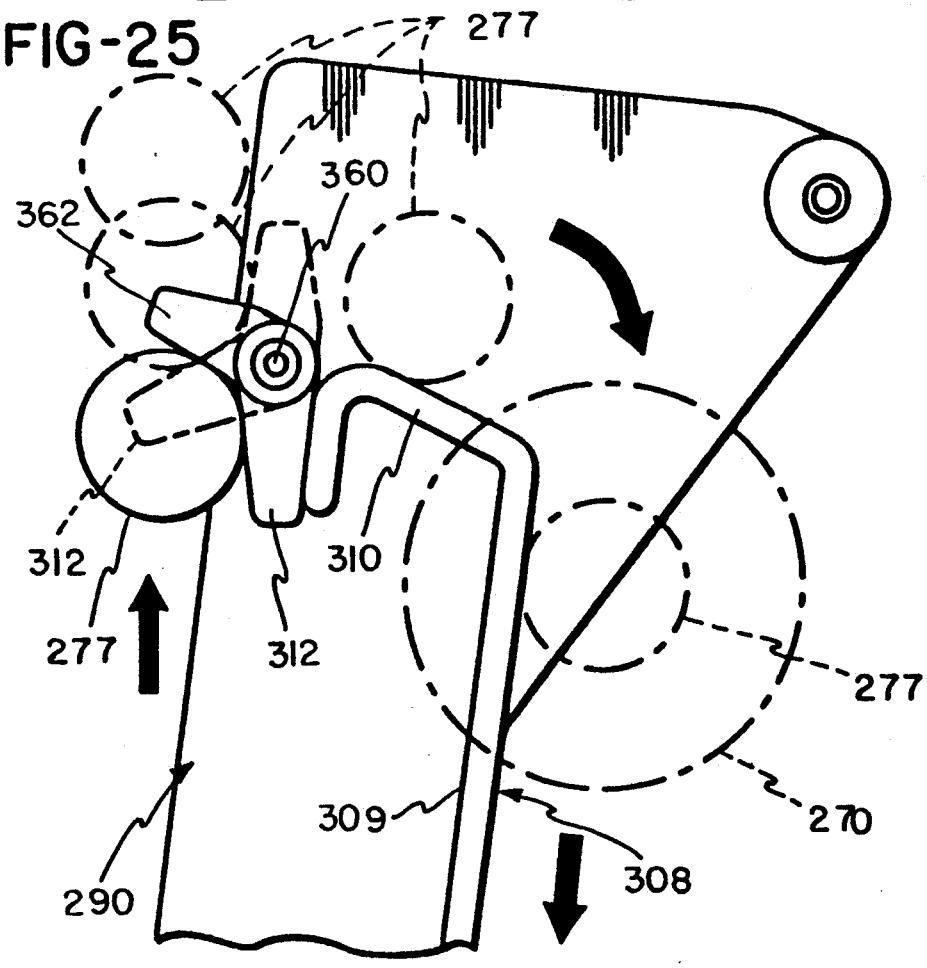
FIG. 25 diagrammatically illustrates the movement of a guide roller assembly of the second embodiment as it completes one cycle and begins another cycle.
Figure 27:
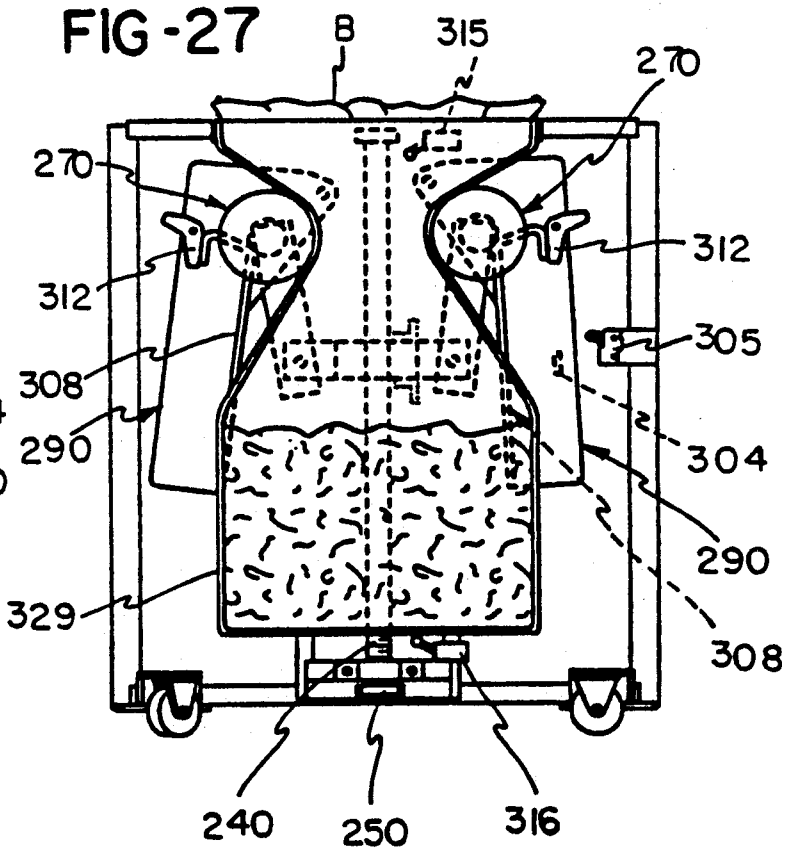
FIGS. 26–34 illustrate the apparatus of the second embodiment in use during the succession of several cycles.
Figure 26:
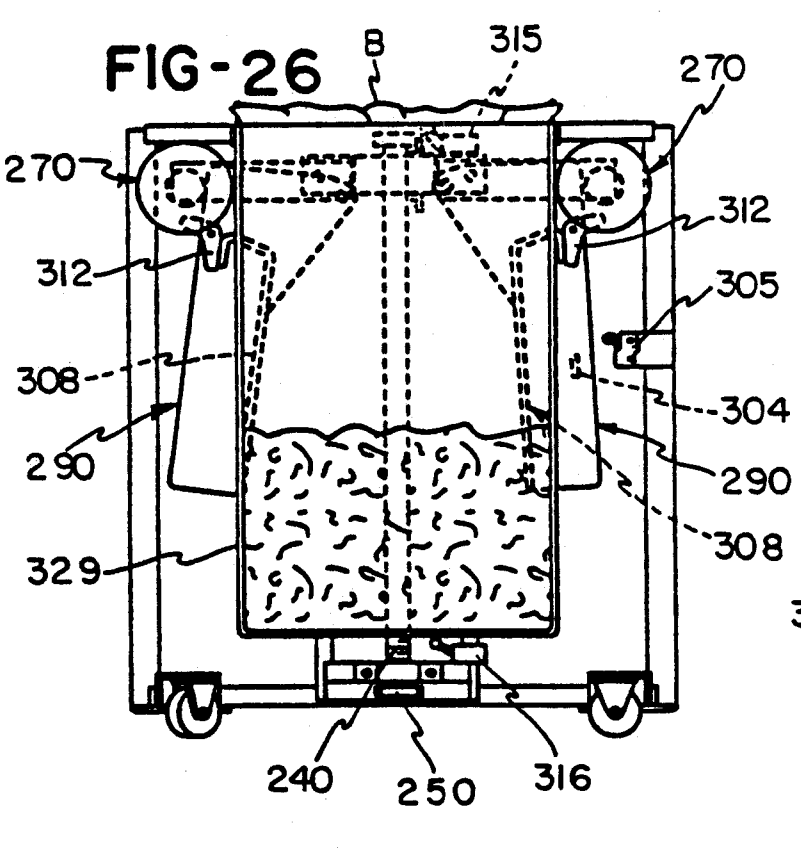

As in the previous embodiment and as may be seen in FIG. 22, pivoted levers 312, 312' are mounted to the plates 290, 290' by pivot means in the form of bolts 360, 360'. The levers 312, 312' operate in the same manner as described for the previous embodiment in that the wheels 277, 277' engage the lower surface of a horizontal extension 362, 362' to cause the lever 360 to pivot upwardly allowing passage of the wheel 277, 277' as the roller assemblies 270 are caused to move upwardly through the apparatus, as may be seen in FIG. 25. Upon the assemblies 270 reaching the upper extent of their travel, the levers 312, 312' will pivot downwardly and the extensions 362, 362' will prevent downward movement of the wheels 277, 277' and guide the wheels toward the guide rail extensions 310.

As may be seen in FIG. 19, at least one of the two pivoted rear plates 290, 290' is provided with a switch bracket 304 for engaging a limit switch 305. As a bag containing material within the apparatus is filled and reaches a maximum amount of filling and compression, the rear plates 290, 290' will pivot outwardly until the bracket 304 contacts the switch 305 whereby the controller for the system is signalled to terminate the cycling of the compression rollers 271 in the same manner as the operation of the switch 105 of the previous embodiment.

It should be noted that the rails 308, 308' on the opposing fixed and pivoted plates 290, 290' are oriented in diverging relationship to each other, as in the previous embodiment and as may be seen in FIG. 20. However, the angle of the fixed rail, relative to vertical, is slightly greater than the initial angle of the pivoted rail.

Figure 33:
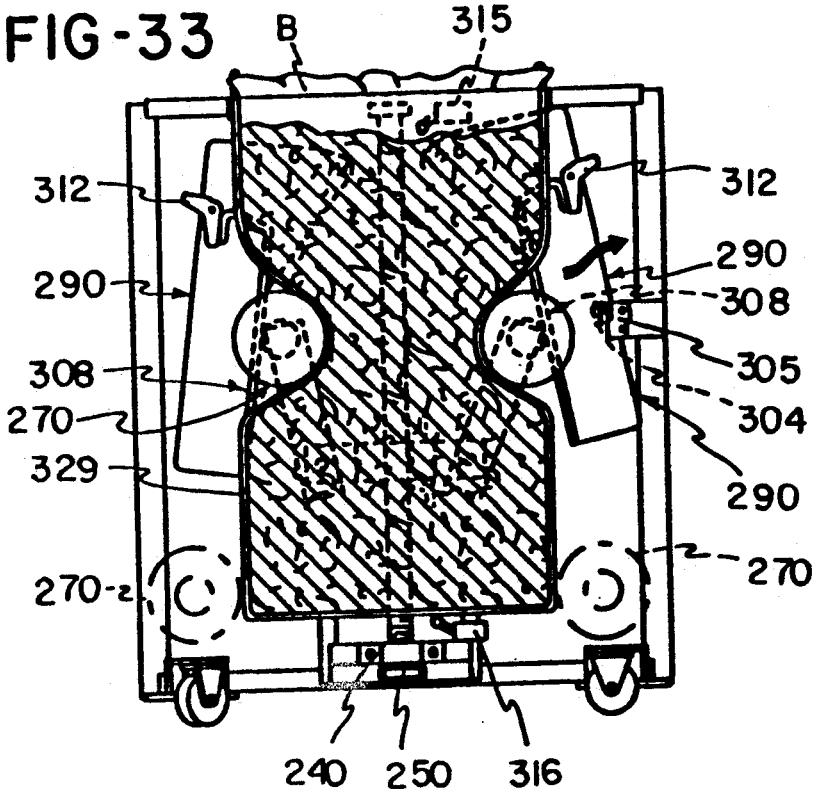
Figure 34:
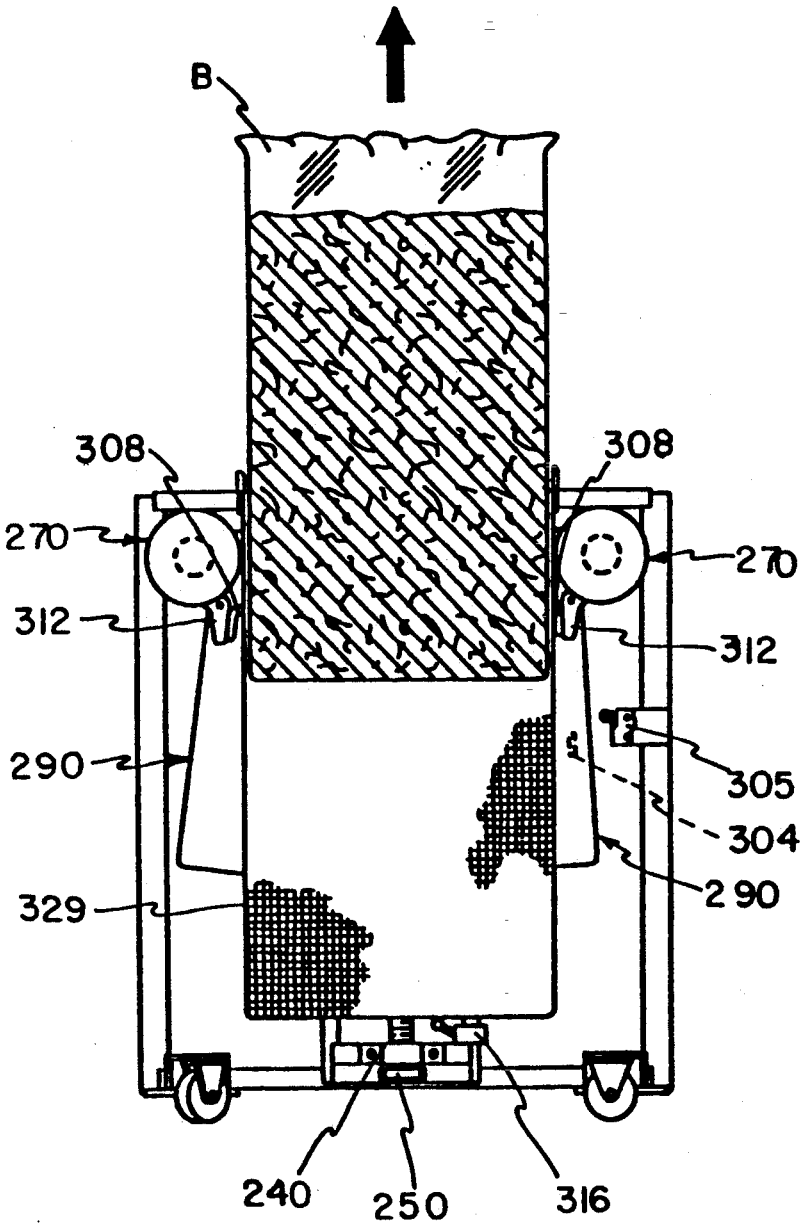

FIGS. 26–34 illustrate the operation of the present embodiment in which it may be clearly seen that only the rear plate 290 pivots outwardly as the bag is filled until the bracket 304 contacts the switch 305, as shown in FIG. 33. The compression and compaction operation of the present embodiment is essentially the same as in the previous embodiment with regard to the control of the motor and the movement of the rollers 271.

It should also be noted that the tie bar 260 carries an upper bracket 366 and a lower bracket 368 for contacting upper and lower limit switches 315 and 316, respectively. Thus, the control and compaction operation of the present embodiment is essentially the same as in the previous embodiment.

Figure 29:
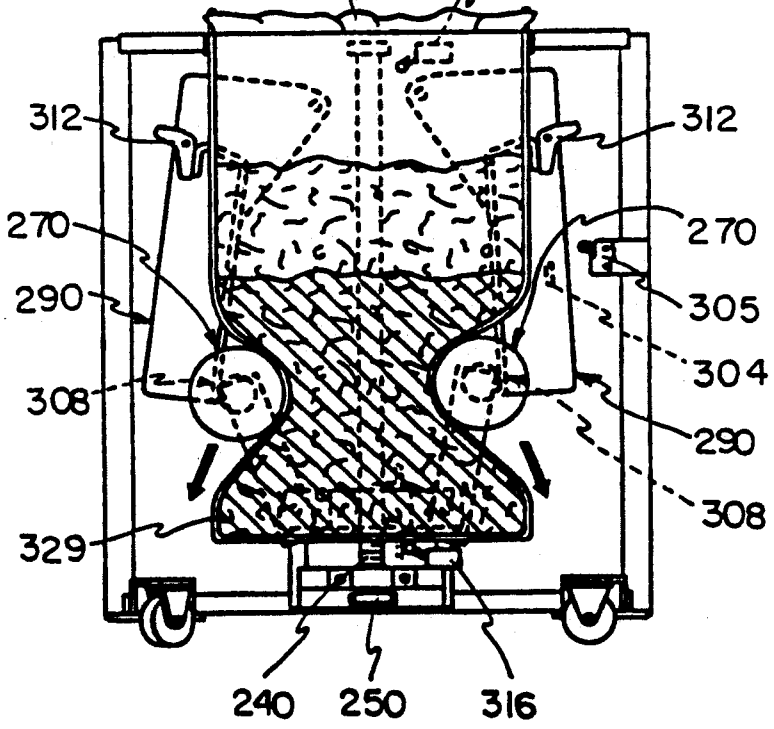
Figure 28:
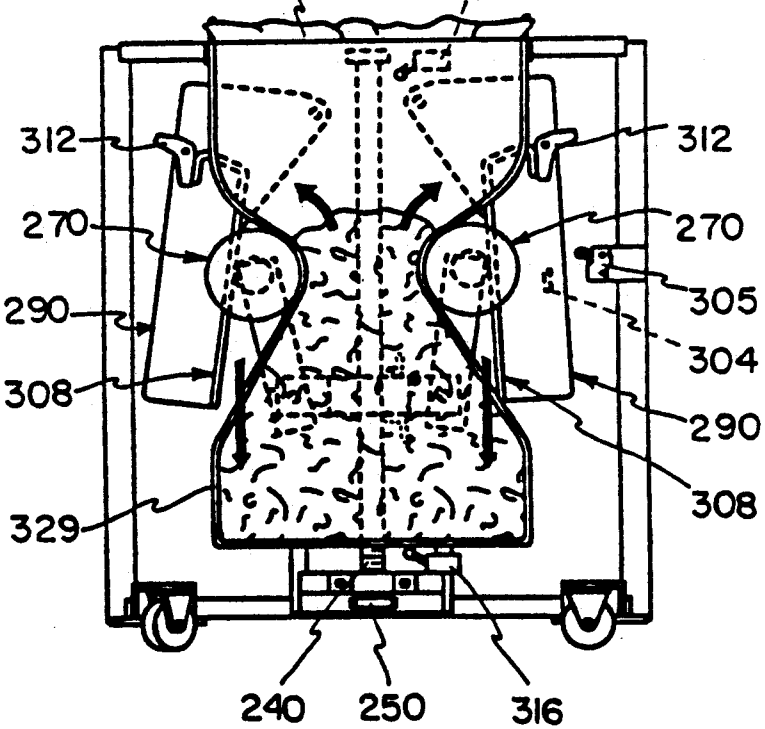
Figure 31:
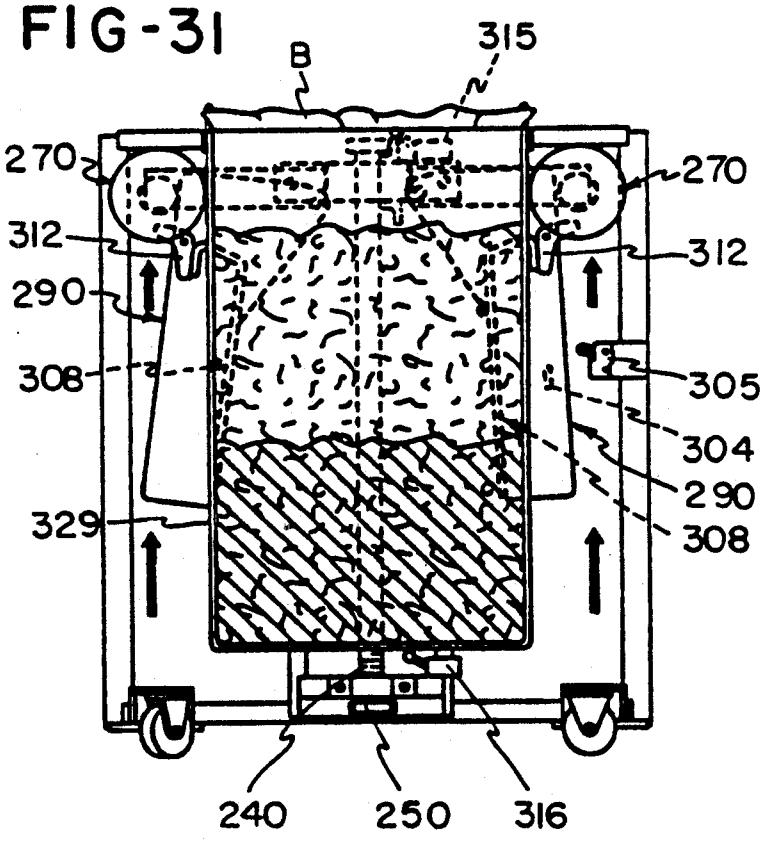
Figure 30:
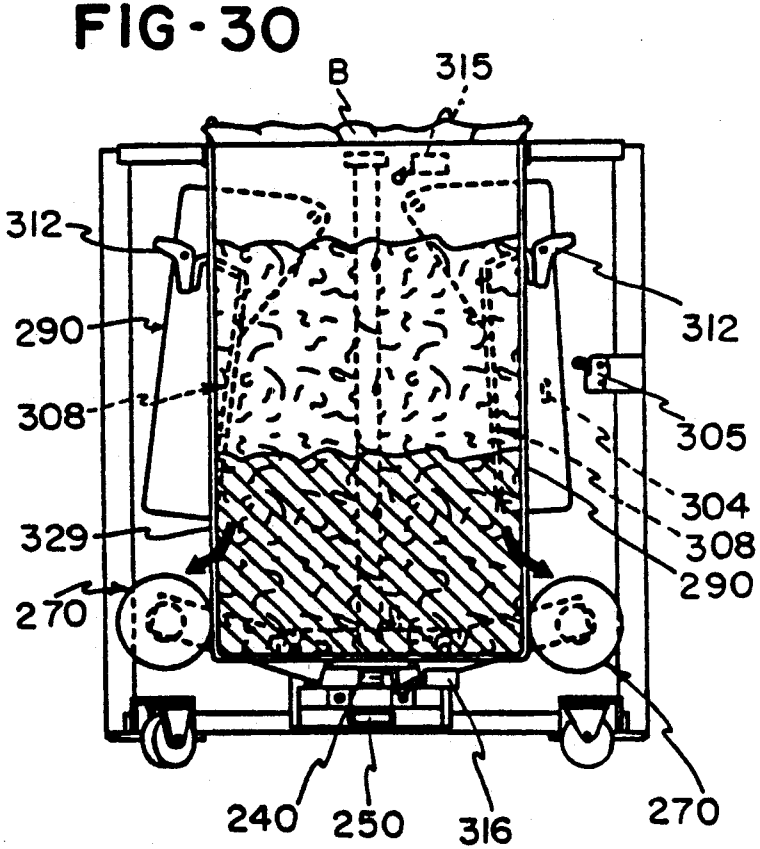
Figure 32:
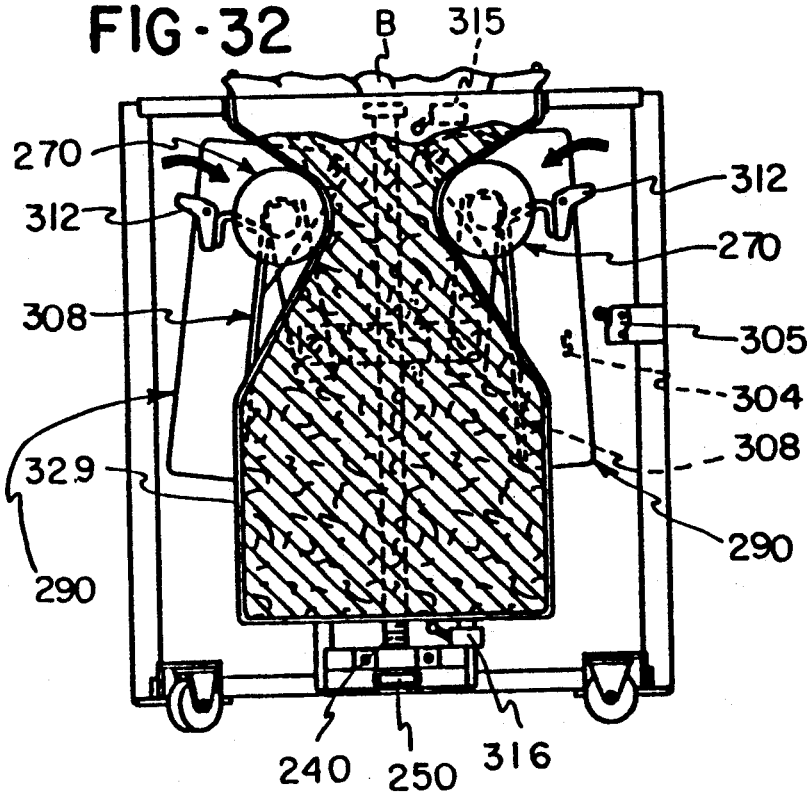

The present apparatus differs from the previous embodiment in that the downward movement of the roller assemblies 270, in passing from the position of FIG. 29 to the position of FIG. 30, is limited by means of belts 370 extending around opposing portions of the bag supporting frame 327. As may be seen in FIG. 21, the belts 370 extend around the rollers 271 and suspend them in a sling-like manner prior to the upward return movement of the tie bar 260. It has been found that the belts 370 provide a much quieter mechanism for stopping the downward movement of the rollers 271 than the bumpers 126 of the previous embodiment.

The present embodiment further includes an elongated bag liner 329 preferably formed of nylon mesh and including four sides and a square bottom. A plurality of hook members 372 are located along the upper edge of the liner 329 and are adapted to hook over the bag support frame 327 for suspending the liner 329 in the central portion of the apparatus.

In addition, the support frame includes four vertically extending pins 374 for perforating an upper edge of a flexible bag B positioned within the bag liner 329. The pins 374 maintain the mouth portion of the flexible bag B in an open position and prevent the bag B from falling into the liner 329.

The apparatus is further provided with a pan 376 supported underneath the liner 329. The pan 376 is intended to catch any debris which may bypass the bag B or the liner 329 to prevent the debris from being discharged onto the drive chain 256 or the underlying floor. Also, a set of wheels 378 is provided for allowing the apparatus to be moved easily to any location.

While the forms of apparatus herein described constitute preferred embodiments of the invention, it is to be understood that the invention is not limited to these precise forms of apparatus, and that changes may be made therein without departing from the scope of the invention which is defined in the appended claims.

What is claimed is:

1. A compacting apparatus for compressing material within a flexible bag having an open mouth portion, said apparatus comprising:

a support frame defining upper and lower portions of said apparatus;

bag support means attached to said frame for supporting a bag with the open mouth portion of the bag adjacent to said upper portion of said apparatus;

compressing means for forcing opposing sides of a bag supported by said bag supporting means inwardly, said compressing means being movable between an upper position adjacent to said upper portion of said apparatus and a lower position adjacent to said lower portion of said apparatus; and guide means extending between said upper and lower positions for controlling the relative position between said compressing means and the bag supported by said bag supporting means, said guide means guiding said compressing means progressively outwardly in a direction away from the bag as said compressing means moves from said upper to said lower position.

2. The apparatus of claim 1, wherein said guide means is movable relative to said support frame, and including biasing means for resiliently biasing said guide means toward the bag.

3. The apparatus of claim 2, including sensing means for sensing movement of said guide means to a predetermined location, said guide means moving to said predetermined location when the bag has been filled to a desired capacity and compressed by said compressing means a predetermined amount.

4. The apparatus of claim 1, wherein said guide means comprises elongated rails and said compressing means comprises rollers mounted for movement relative to said rails, said rails providing a biasing force to said rollers whereby the contents of the bag will be compressed as said rollers move relative to the bag.

5. The apparatus of claim 4, wherein at least one pair of rails are provided, said rails extending in diverging relationship to each other in a direction from said upper portion to said lower portion of said apparatus.

6. The apparatus of claim 1, wherein said compressing means comprises a pair of opposing rollers and support bars mounting each of said rollers to at least one tie bar, said support bars being pivotally movable relative to said at least one tie bar and said at least one tie bar being movable from said upper portion to said lower portion of said apparatus.

7. The apparatus of claim 6, wherein said guide means comprises rails for guiding said rollers, said support bars being pivoted upwardly relative to said at least one tie bar toward said upper portion as said at least one tie bar moves from said upper portion to said lower portion of said apparatus.

8. The apparatus of claim 7, including a pair of belts, each of said belts being attached to said frame and extending around one of said rollers such that as said rollers reach a lower extent of said rails, said support bars will pivot downwardly and cause said rollers to engage and be supported by said belts.

9. The apparatus of claim 7, wherein said support bars and rollers pivot outwardly as said rollers reach a lower extent of said rails and said rails each include a pivoted lever at an upper extent of said rails proximate said upper position, said pivoted levers allowing passage of said rollers upwardly and guiding said rollers inwardly toward the bag supported in said bag support means upon movement of said tie bar downwardly toward said lower portion of said apparatus.

10. The apparatus of claim 6, including vertical screw means extending from said upper to said lower portion of said apparatus, said at least one tie bar including means defining a threaded aperture for engaging said screw means such that rotation of said screw means results in vertical movement of said at least one tie bar to move said rollers between said upper and lower positions.

11. The apparatus of claim 1, including pivot means mounted to said guide means and lever means mounted to said pivot means for pivotal movement about said pivot means and relative to said guide means, said lever means acting to permit passage of said compressing means during movement of said compressing means from said lower to said upper position and subsequent to permitting passage of said compressing means, acting to guide said compressing means inwardly toward the bag supported by said bag supporting means.

12. The apparatus of claim 1, wherein said bag support means includes an elongated bag liner formed of a flexible material and positioned to surround a bag supported by said bag support means, said compressing means contacting and biasing said bag liner toward a center portion of said support frame.

13. The apparatus of claim 12, wherein said bag support means includes a plurality of elongated perforating members located adjacent to said upper portion of said apparatus for engaging and perforating a peripheral edge of the bag surrounded by said bag liner.

14. The apparatus of claim 1, wherein said guide means includes at least one rail for biasing said compressing means toward the bag supported by said support means.

15. The apparatus of claim 14, wherein a pivot support is attached to said support frame adjacent to said upper portion of said apparatus and said at least one rail is supported by said pivot support such that said at least one rail extends from a point adjacent to said pivot support toward said lower portion of said apparatus to allow pivotal movement of said at least one rail.

16. The apparatus of claim 14, wherein said compressing means includes a roller and means mounting the roller for free rotation during movement from said upper to said lower portion.

17. The apparatus of claim 14, wherein said compressing means includes a roller and said guide means further includes an additional rail parallel to said at least one rail, said roller including means for engaging said additional rail whereby said roller is driven to rotate.

18. A compacting apparatus for compressing material within a flexible bag, said apparatus comprising:

a support frame defining upper and lower portions of said apparatus;

bag support means for supporting a bag in a central portion of said apparatus extending from said upper to said lower portion of said apparatus;

compressing means mounted for vertical movement between upper and lower positions at said upper and lower portions of said apparatus, respectively;

guide means having upper and lower ends located adjacent to said upper and lower positions, respectively, for biasing said compressing means toward said central portion of said apparatus;

pivot support means attached to said frame for supporting said guide means adjacent to one of said ends, said pivot support means permitting pivotal movement of said guide means relative to said support frame; and wherein said compressing means undergoes a compression phase movement in which said compressing means moves relative to said guide means between said upper and lower positions to pass through said central portion of said apparatus and compress material contained within a bag supported by said bag support means, said pivot support means acting to permit said guide means to move outwardly away from said central portion of said apparatus as the bag is filled with material.

19. The apparatus of claim 18, wherein said compressing means follows a loop-like path including the sequence of movement through said central portion during said compression phase of movement, moving outwardly away from said central portion, a return phase of movement in which said compressing means is moved substantially parallel to and in an opposite direction of said compression phase of movement and an inward movement toward said central portion.

20. The apparatus of claim 19, including drive means capable of providing a driving output in first and second opposite directions such that operation of said driving means in said first direction causes said compressing means to move through said compression phase of movement and operation of said driving means in said second direction causes said compressing means to move through said return phase of movement.

21. The apparatus of claim 19, wherein said guide means include rail means extending substantially vertically adjacent to said central portion, extension surface means extending transversely to said rail means and pivot lever means mounted for pivotal movement relative to said extension surface means, said extension surface means and said pivot lever means defining the path followed by said compressing means during said inward movement toward said central portion.

22. The apparatus of claim 21, wherein said pivotal lever means is caused to pivot upwardly to allow passage of said compressing means at the conclusion of said return phase of movement and said pivot lever means subsequently pivoting downwardly to guide said compressing means toward said extension surface means.

* * * * *